US005383733A

United States Patent [19]

Zinsmeyer et al.

[11] Patent Number: 5,383,733

[45] Date of Patent: Jan. 24, 1995

[54] RIBBON CASSETTE FOR A PRINTER

[75] Inventors: Charles D. Zinsmeyer; James A. Parnell; Dan R. Poole, all of Austin, Tex.; Carl D. Massey, Nashville, Tenn.

[73] Assignee: Summagraphics Corporation, Austin, Tex.

[21] Appl. No.: 33,876

[22] Filed: Mar. 19, 1993

Related U.S. Application Data

[63] Continuation-in-part of Ser. No. 920,116, Jul. 24, 1992, Pat. No. 5,267,802.

[51] Int. Cl.[6] ..... B41J 35/28

[52] U.S. Cl. ..... 400/208; 400/247; 242/340; 242/345.2

[58] Field of Search ..... 400/208, 247, 196, 207; 242/197

[56] References Cited

U.S. PATENT DOCUMENTS 3,989,132 11/1976 Carson, Jr. .
4,288,798 9/1981 Hollmayer .

(List continued on next page.)

FOREIGN PATENT DOCUMENTS

| | | | |
|---|---|---|---|
| 2097362 | 11/1982 | European Pat. Off. | 400/208 |
| 0083926 | 7/1983 | European Pat. Off. | 400/208 |
| 0157076 | 10/1985 | European Pat. Off. | 400/208 |
| 0194694 | 9/1986 | European Pat. Off. | 400/208 |
| 0351515 | 1/1990 | European Pat. Off. | 400/247 |
| 0470648 | 2/1992 | European Pat. Off. | 400/208 |
| 2824454 | 12/1979 | Germany | 400/208 |
| 2942976 | 9/1980 | Germany . | |
| 3705056 | 9/1988 | Germany | 400/208 |
| 0124687 | 7/1983 | Japan | 400/208 |
| 0046280 | 3/1985 | Japan . | |
| 0072776 | 4/1985 | Japan . | |
| 0029578 | 2/1986 | Japan . | |
| 0160272 | 7/1986 | Japan | 400/208 |
| 1110180 | 4/1989 | Japan | 400/208 |
| 1195088 | 8/1989 | Japan | 400/208 |
| 0022083 | 1/1990 | Japan | 400/208 |
| 4220385 | 8/1992 | Japan | 400/208 |

OTHER PUBLICATIONS

"Embedded Graphite Lamination on Thermal Ribbon" IBM Tech. Discl. Bulletin, vol. 25, No. 7A, Dec. 1982, p. 3193.

"Ribbon Cartridge with Brake" IBM Technical Disclosure Bulletin, vol. 10, No. 4, Sep. 1967 pp. 484–485.

"Automated Cartridge Assembly Machine" IBM Technical Disclosure Bulletin, vol.

*Primary Examiner*—Eugene H. Eickholt
*Attorney, Agent, or Firm*—Rosen, Dainow & Jacobs

[57] ABSTRACT

A cassette for ribbon for a printer, particularly a thermal printer, is disclosed. The cassette is configured to be stably mounted to a print carriage of a thermal printer, or to a storage turret mounted to the printer for storing a number of cassettes, and to be transferred by a passive transfer system between the print carriage and the storage turret simply in response to movement of the print carriage. A smooth, low friction path is provided for the ribbon within the cassette with no acute angle changes in the path when the cassette is in a printing position and being acted upon by the printer's print head. The cassette is provided with a brake mechanism which automatically engages the supply and take-up reels in the cassette when the cassette is removed from the print carriage, and automatically disengages the brake mechanism when the cassette is mounted to the print carriage. The cassette is provided with a bar code so that cassettes on the storage turret may automatically be identified, particularly for use in an automatic cassette transfer system. The cassette housing is plastic and is provided with an anti-static additive.

26 Claims, 11 Drawing Sheets

U.S. PATENT DOCUMENTS

| | | | |
|---|---|---|---|
| 4,290,567 | 9/1981 | Saito . | |
| 4,302,118 | 11/1981 | Schaefer . | |
| 4,350,452 | 9/1982 | Dials et al. | 400/208 |
| 4,367,963 | 1/1983 | Daughters | 400/208 |
| 4,413,920 | 11/1983 | Matthias et al. . | |
| 4,426,168 | 1/1984 | Jozuka et al. . | |
| 4,469,459 | 9/1984 | Trezise et al. . | |
| 4,517,573 | 5/1985 | Yana . | |
| 4,564,303 | 1/1986 | Rosenberg et al. . | |
| 4,569,608 | 2/1986 | Watanabe . | |
| 4,594,011 | 6/1986 | Hayashi . | |
| 4,620,199 | 10/1986 | Tatsumi et al. . | |
| 4,622,563 | 11/1986 | Watanabe et al. . | |
| 4,624,592 | 11/1986 | Purcell . | |
| 4,630,948 | 12/1986 | Karns . | |
| 4,647,232 | 3/1987 | Costa . | |
| 4,660,054 | 4/1987 | Kajikawa et al. . | |
| 4,674,895 | 6/1987 | Tanaka et al. . | |
| 4,694,305 | 9/1987 | Shiomi et al. . | |
| 4,702,631 | 10/1987 | Watanabe | 400/208 |
| 4,712,115 | 12/1987 | Tatsumi et al. . | |
| 4,750,008 | 6/1988 | Matsuura . | |
| 4,770,553 | 9/1988 | Deschamps et al. . | |
| 4,776,714 | 10/1988 | Sugiura et al. | 400/208 |
| 4,778,290 | 10/1988 | Costa et al. . | |
| 4,789,873 | 12/1988 | Matsuura . | |
| 4,809,018 | 2/1989 | Nakamura et al. . | |
| 4,820,067 | 4/1989 | Surti | 400/208 |
| 4,860,876 | 8/1989 | Moore et al. . | |
| 4,867,586 | 9/1989 | Shimoyama | 400/208 |
| 4,867,587 | 9/1989 | Kishida et al. . | |
| 4,952,086 | 8/1990 | Yamaguchi . | |
| 4,982,202 | 1/1991 | Buan et al. . | |
| 4,988,224 | 1/1991 | Furrow et al. . | |
| 4,997,076 | 3/1991 | Hirschfeld et al. . | |
| 5,039,232 | 8/1991 | Kerzel et al. . | |
| 5,053,814 | 10/1991 | Takano et al. | 271/265 |
| 5,085,531 | 2/1992 | Gillio . | |
| 5,110,228 | 5/1992 | Yokomizo | 400/208 |
| 5,127,750 | 7/1992 | Burgin | 400/208 |
| 5,148,403 | 9/1992 | Gardner . | |
| 5,180,236 | 1/1993 | Kitahara et al. . | |
| 5,186,553 | 2/1993 | Sugiura et al. | 400/248 |

62
63
64
48
45
46
150
39
52
65
37
49
51
61
47
60
127
125
75
77
76
78
79
36
132
130
123
120
54
131
50
141
133
137
139
135
140
138
136
122
128
42

87
150
65
45
64
63
62
26
24
22
61
37
39
45
80
77
79
76
75
60
127
120
130
125
132
121
78
77
78
80
131
141
54
30
133
137
139
135
140
138
136
133
131
132
125
120
122
130
36
128
150
87

RIBBON CASSETTE FOR A PRINTER

This application is a continuation-in-part of application Ser. No. 07/920,116, now U.S. Pat. No. 5,267,802 filed Jul. 24, 1992, titled "RIBBON CASSETTE STORAGE AND TRANSFER APPARATUS FOR A PRINTER" ("the '116 Application").

The invention disclosed in this application may be employed in the thermal printer disclosed in the following U.S. patent applications, all filed on Jul. 24, 1992: Ser. No. 07/920,186 titled "STRIP MODE PRINTING AND PLOTTING APPARATUS AND METHOD"; Ser. No. 07/919,666 titled "THERMAL STRIP MODE PRINTER COMPONENTS AND SUBASSEMBLIES; Ser. No. 07/920,115 titled "SHEET MEDIUM TRANSPORT SYSTEM, PARTICULARLY FOR PRINTERS AND PLOTTERS"; and with the cassette storage and transfer apparatus and described in the '116 Application. The reel diameter determining method and apparatus, and the ribbon tensioning method and apparatus disclosed in Ser. No. 07/920,117 now U.S. Pat. No. 5,267,401 titled "METHOD and APPARATUS FOR GAUGING REEL DIAMETERS IN A REEL-TO-REEL SHEET MATERIAL TRANSPORT SYSTEM", filed Jul. 24, 1992 may be used with the cassette disclosed herein. The disclosures of all of the five patent applications referenced above (collectively referred to herein as "the cited applications") are incorporated herein by reference. The cited applications and this patent application are commonly owned.

BACKGROUND OF THE INVENTION

The invention disclosed herein relates to a cassette containing strip, tape or ribbon material (hereafter referred to simply as "ribbon") containing, for example, pigment, wax, resin, ink, etc., particularly for use with printers and plotters. However, the invention is not limited to cassettes containing ribbon for use in printing or plotting.

While the cassette disclosed herein may be used in any suitable printer or plotter, the cassette finds particular application in the thermal strip mode printer described in the cited applications. The cassette disclosed herein may be stored an a turret device, carried by a print carriage during use and moved between the turret storage device and the print carriage as described herein and in the cited applications.

The thermal printer described in the cited applications is capable of thermal transfer printing in wide formats of up to about 36 inches. In doing so, that thermal printer prints in a strip mode of printing where the print or plot is printed one strip at a time in widths (Y-axis direction) of about one inch to about four inches, with strips of about two inches being presently preferred. To print in strips of about two inches in width requires a thermal transfer ribbon of slightly more than two inches in width. In order to provide enough ribbon to print approximately 50 typical color, graphic D size plots, and approximately 100 color typical line art D size plots, width, about 500M of ribbon of each of the four colors in the four color yellow, magenta, cyan and black system are typically required. As a result, reel-to-reel cassettes incorporating that amount of ribbon will have considerable size.

The thermal printer described in the cited applications is a color printer which automatically prints in different colors to provide a composite color print or plot. In order to automatically print in color, the thermal printer incorporates a number of reel-to-reel cassettes each containing ribbon of a different color. In the presently preferred embodiment, the four color system referred to above is used for color printing, which requires four ribbons. Also as presently preferred, the thermal printer includes a primary four color system and a redundant four color system, and therefore incorporates a total of eight reel-to-reel cassettes.

The thermal printer described in the cited applications incorporates an automatic transfer system for transferring ribbons between a storage location and a printing location on a movable print carriage which carries a thermal print head. As described in the cited applications and herein, the transfer system is passive in that the transfer mechanism itself is not servo controlled and operates simply in response to movement of the print carriage towards and away from the cassette storage device, which in the preferred embodiment is a rotatable turret.

Given the relatively large size cassette required to hold 500M of about two inch wide ribbon, and given the stringent requirements for thermal transfer printing described in the cited applications and herein, unwanted movement of ribbon could cause serious problems.

The cassette disclosed herein and in the cited applications was invented in consideration of the factors mentioned in the cited applications and herein, including: size constraints for mounting eight relatively large cassettes in a printer incorporating automatic cassette transfer; configuration constraints on the cassette so as to efficiently mount a number of them on the turret, and one on the print carriage in an efficient print position; preventing unwanted movement of the ribbon in a simple and efficient manner; a simple automatic cassette transfer system; providing for smooth and efficient ribbon delivery to the print head and back to the cassette; protecting the ribbon from contamination and physical damage; possible recycling of the entire cassette or parts thereof; providing an accessible customer interface which protects the customer and reduces difficulties that the customers will have in handling the cassettes; and identifying the cassettes on the turret in a simple manner.

There is therefore a need for ribbon cassettes which satisfy all or various combinations of the factors discussed herein and in the cited applications.

OBJECTS AND SUMMARY OF THE INVENTION

It is an object of the invention disclosed herein to provide an improved ribbon cassette for a printer or plotter.

Another object of the invention is to provide a ribbon cassette having a bar code which identifies the cassette and/or at least one characteristic thereof and a means for reading the bar code on the cassette while the cassette is mounted to a rotating storage turret.

Another object of the invention is to provide a ribbon cassette in which the status of ribbon available for use (and/or status of used ribbon) may be visually detected.

Another object of the invention is to improve the mounting in a ribbon cassette of the ribbon supply and take-up reels.

Another object of the invention is to contain and/or dissipate static build up on a ribbon in a ribbon cassette.

Another object of the invention is to minimize friction in a ribbon cassette between the ribbon and the cassette.

Another object is to prevent wrinkling of the ribbon during the printing process and to optimize the ribbon path for use in a thermal printer.

Another object of the invention is to improve transfer of a ribbon cassette between a use location on a print carriage and a storage location off the print carriage.

Another object is to improve the mounting of a ribbon cassette to a print carriage of a thermal printer;

Another object of the invention is to stably secure a ribbon cassette both to a print carriage and to a storage device off the print carriage.

Another object of the invention is to prevent movement of the ribbon in a cassette when not printing.

The invention disclosed herein in its various aspects achieves the above and other objects of the invention by providing a cassette having two major opposed sides and a peripheral side therebetween in which holes on one side are used to mount the cassette to a mounting structure from one side of the cassette, and holes on the opposing side are used to mount the cassette to a mounting structure from the other side of the cassette. The two mounting structures may be different mounting structures, one being on a print carriage carrying a print head which acts on the ribbon carried by the cassette to print on a sheet medium, and the other being a storage element for holding cassettes for transfer to the mounting structure on the print carriage. This allows the storage element and the print carriage to be mounted side by side so that transfer of a cassette between the print carriage and the storage element may be effected passively as described herein simply by moving the print carriage so that its mounting structure engages the mounting structure of the storage element. The number and locations of the holes are selected so that the cassette may be stably guided during a transfer and stably mounted to both the print carriage and the storage element.

In the preferred embodiment, there are first and second spaced holes in the first major side for receiving respective pins projecting from a mounting structure (e.g., on a print carriage) for mounting the cassette to the mounting structure with the first major side facing the mounting structure, and third and fourth spaced holes in the second major side for receiving respective pins projecting from a mounting structure (e.g., a storage element) for mounting the cassette to that mounting structure with the second major side facing that mounting structure.

The cassettes have a pair of spaced projections on the peripheral edge of the housing for engaging arms on a mounting structure, and a cassette is mounted to the mounting structure by engagement of the arms on the mounting structure with the lugs on the cassette and entry of pins projecting from the mounting structure into the holes on the same side of the cassette which faces the mounting structure when the cassette is mounted thereto. The cassette is mounted in generally the same way from either side of the cassette, except that the holes are located differently on opposite sides of the cassette to optimize mounting of the cassette from one side and yet satisfy certain requirements for mounting the cassette from the other side. The cassette is structured such that there is space within the cassette for the pins to project within the cassette a distance sufficient to guide the cassette as it is being mounted to the mounting structure, and to stably mount the cassette to mounting structure from either side of the cassette. In the preferred embodiment, there is space within the cassette for all of the pins to project simultaneously within the cassette from both major sides substantially from major side to major side.

The cassette has a center of gravity, and in the preferred embodiment, the first and second holes are positioned as follows: the first hole is positioned on one side of the center of gravity adjacent the peripheral edge of the cassette; the second hole is positioned on an opposite side of the center of gravity adjacent the peripheral edge; and the first and second holes are positioned such that a first line connecting the center of the first and second holes passes through a central part of the cassette. The third and fourth holes are substantially spaced apart with each positioned adjacent the peripheral edge of the cassette and such that a second line connecting the center of the third and fourth holes intersects the first line at an angle of from about 60° to about 120°, and preferably about 90°.

In the preferred embodiment, the housing comprises a body and includes spaced arms projecting from the body which terminate in the inlet and outlet, the first and second holes being positioned in the body spaced from the arms, and the third and fourth holes being positioned in or near the arms. The cassette comprises a first reel (e.g., a supply reel) rotatably mounted in the housing having an axis perpendicular to the major sides and a second reel (e.g., a take-up reel) rotatably mounted in the housing having an axis perpendicular to the major sides, the first and second reels being laterally spaced in the housing, and the first and second holes being positioned such that a first line connecting the center of the first and second holes passes between respective axes of the reels and a second line connecting the center of the third and fourth holes does not.

The cassette has means associated at least with one of the reels (e.g., the take-up reel) for permitting that reel to be driven and means for guiding ribbon along a path from the first reel to the outlet of the housing and from the inlet of the housing to the second reel. The arms are configured to project ribbon exteriorly of the cassette spaced therefrom such that a print head may act upon the ribbon between the arms exteriorly of the cassette. The guiding means comprises a plurality of guides for guiding ribbon in the path from the first reel to and from the outlet, and a plurality of guides for guiding ribbon in the path from the inlet to the second reel. The guides are positioned and configured such that in a use configuration of the cassette with the print head acting upon the ribbon, the guides introduce only oblique angle changes in the path. The guides are positioned and configured such that in a non-use configuration of the cassette when the print head is not acting upon the ribbon, the guides introduce not more than one angle change which is approximately an acute angle.

The reels are mounted for low friction rotation. The cassette includes means for rotatably mounting the reels in the housing including means held from rotating in the housing positioned in the housing adjacent the ends of the axles on which the ends of the axles bear and rotate. The reels each include structure which may be engaged through respective holes in a first of the major sides of the cassette by apparatus for rotating or braking a respective reel from a side of the reel opposite the one side, and guiding means for loosely guiding the reels at the ends opposite the one end while permitting the reels to rotate, whereby the reels are loosely captivated in the cassette when not engaged by the apparatus for rotating or braking. The axle end is rounded to provide an area of contact thereon which is substantially less than the cross-sectional area of the axle, and the means on which the ends of the axles bear and rotate comprise a planar surface having relatively low friction. The guiding means comprises respective holes in the first major side of the cassette which have a larger diameter than the diameter of the reels such that the holes loosely guide the outer periphery of the opposite sides of the reels, and means acting on the planar surfaces for resiliently urging the axles towards the first major side.

The cassette according to the invention is provided with a brake mounted in the housing for frictionally engaging at least one of the reels in any angular position thereof in response to the cassette not being mounted to the mounting structure and for not frictionally engaging the reel in response to the cassette being mounted to the mounting structure. The brake does not frictionally engage the reel when a pin from a mounting structure is present within the cassette projecting therein through one of the holes in the side of the cassette discussed above, and the brake frictionally engages the reel when the pin is not in the hole.

The brake comprises an arm pivotably mounted in the housing having a free end which frictionally engages the reel in a first position of the arm and does not engage the reel in a second position of the arm, means urging the arm into its first position, and means positioned in alignment with the hole so as to be contacted by the pin of the mounting means for pivoting the arm towards the second position in response to the pin projecting in the hole. Removal of the pin from the hole allows the arm to pivot to its first position with the free end of the arm in frictional engagement with the one reel. Preferably, the arm is configured and positioned so that when the arm is in frictional engagement with the reel, the arm applies a harder braking force to the reel when the reel is urged to rotate or does rotate in a direction to unwind ribbon therefrom. In the preferred embodiment, a brake is provided for each of the reels.

A see-through window is preferably provided in a major side of the housing adjacent at least one of the reels positioned a given distance radially from the axis of the reel such that ribbon wound on the reel may be gauged by the naked eye from the exterior of the cassette. In the preferred embodiment, the window is an opening on a major side and is positioned adjacent the supply reel.

A bar code is preferably positioned on a major side of the cassette. Preferably the bar code is a linear bar code positioned adjacent the peripheral side and has a longitudinal axis, and the bar code is oriented such that the longitudinal axis is at approximately 90° to a line passing through the axes of the reels.

A plurality of cassettes are stored on a storage element in an adjacent relationship extending about a circle with the major side of each of the cassettes having the bar code thereon facing away from the storage element. Means are provided for machine reading the bars codes comprising means for rotating the storage element, and a bar code reader positioned adjacent the storage element spaced therefrom sufficiently to permit the cassettes to pass by the bar code reader. The linear bar code is positioned on each of the cassettes and the cassettes are positioned on the storage element such that the linear bar code on each cassette passes the bar code reader when the storage element is rotated. The linear bar code is preferably mounted on the major side of the cassette at substantially the greatest radius from the axis of rotation of the storage element.

The cassette housing is preferably made of plastic and includes a conductive additive, and the housing is in contact with the ribbon as the ribbon is moved for conducting static charge on the ribbon from the ribbon to the housing. Also, the ribbon preferably has a conductive coating for conducting static charge.

The cassette preferably includes means for removably attaching one of the major sides to the housing such that it may be removed to gain access to the interior of the housing to remove and replace ribbon therein. However, both sides may be non-removably attached to the housing, if desired.

BRIEF DESCRIPTION OF THE DRAWINGS

The invention disclosed herein is illustrated in the figures of the accompanying drawings which are meant to be exemplary and not limiting, in which like references refer to like or corresponding parts, and in which.

DESCRIPTION OF THE PREFERRED EMBODIMENTS

Ribbon cassette 10 (FIG. 1) according to the invention is especially suited for carrying a thermal donor medium for use in a thermal printer. A cassette 10 according to the invention has particular application to the strip mode thermal printer described in the cited applications. However, the invention is not limited to a cassette for carrying a thermal donor medium, and is applicable to cassettes for carrying other types of strip material, tape or ribbon, and is not limited to use in thermal transfer printers, and is applicable to other printers and to applications other than printing or plotting.

Figure 1:
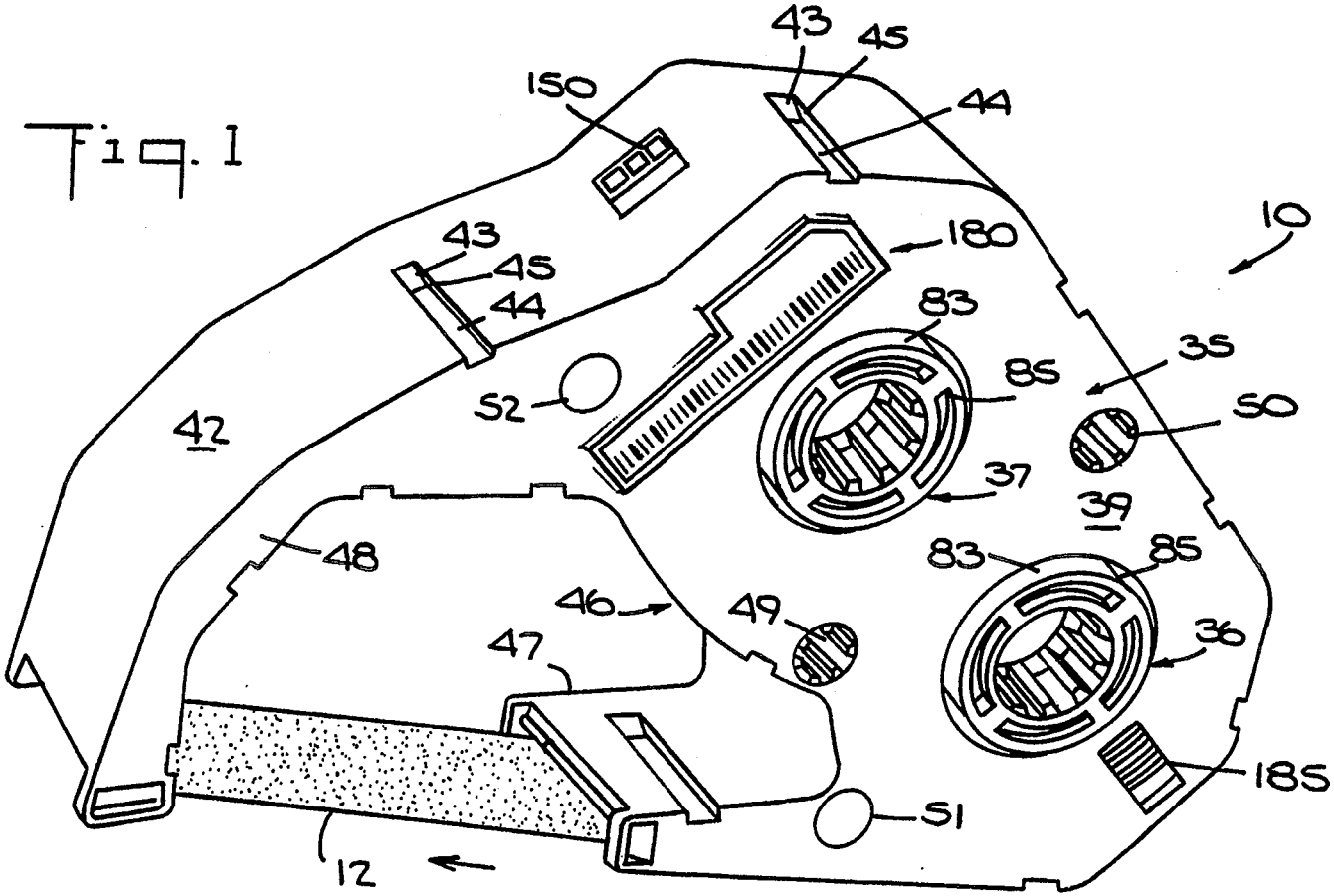
FIG. 1 is a perspective view from one side (carriage or right side) of a ribbon cassette according to the invention.
Figure 2:
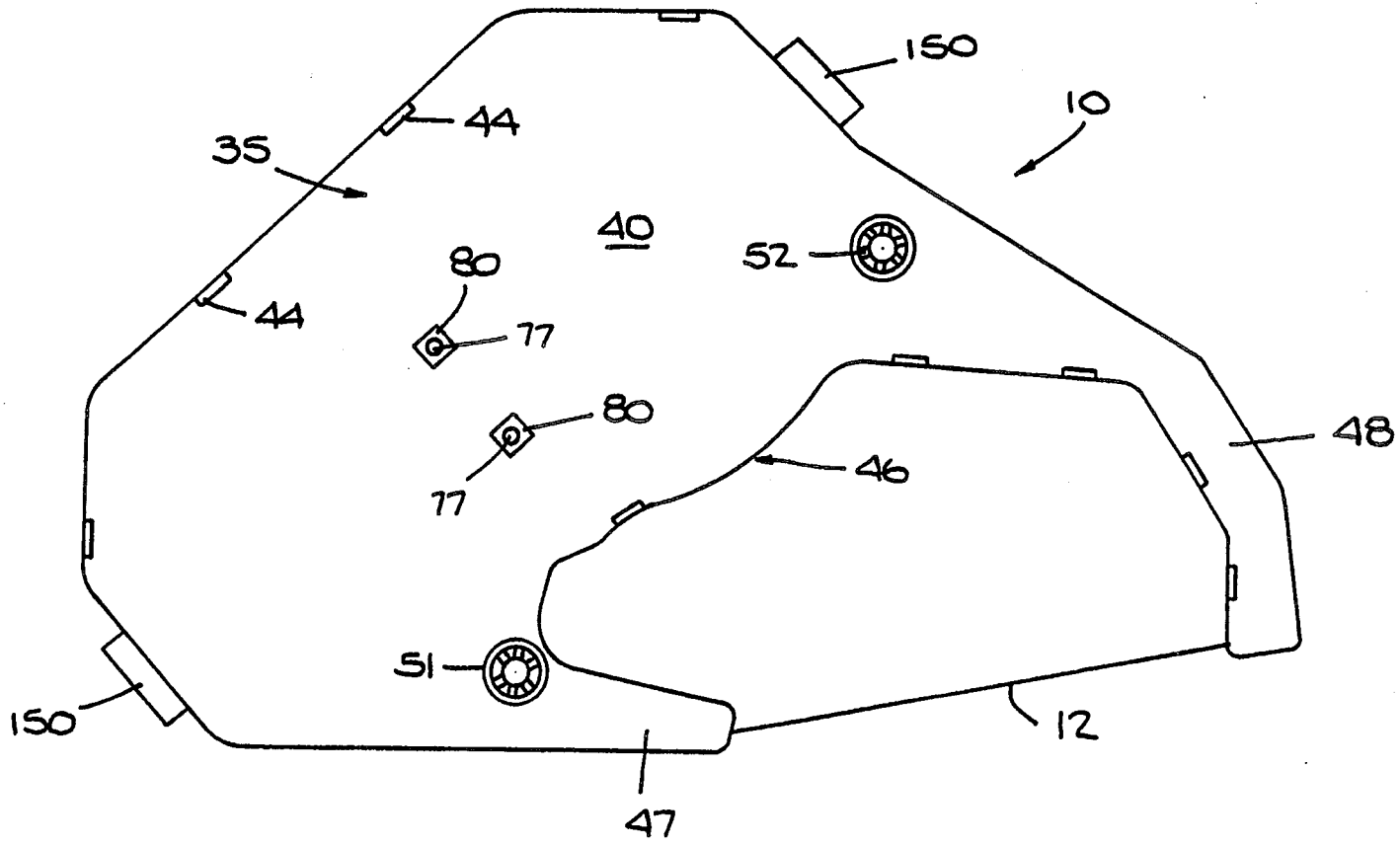
FIG. 2 is an elevation view of the opposite side (turret or left side) of the ribbon cassette shown in FIG. 1.
Figure 3:
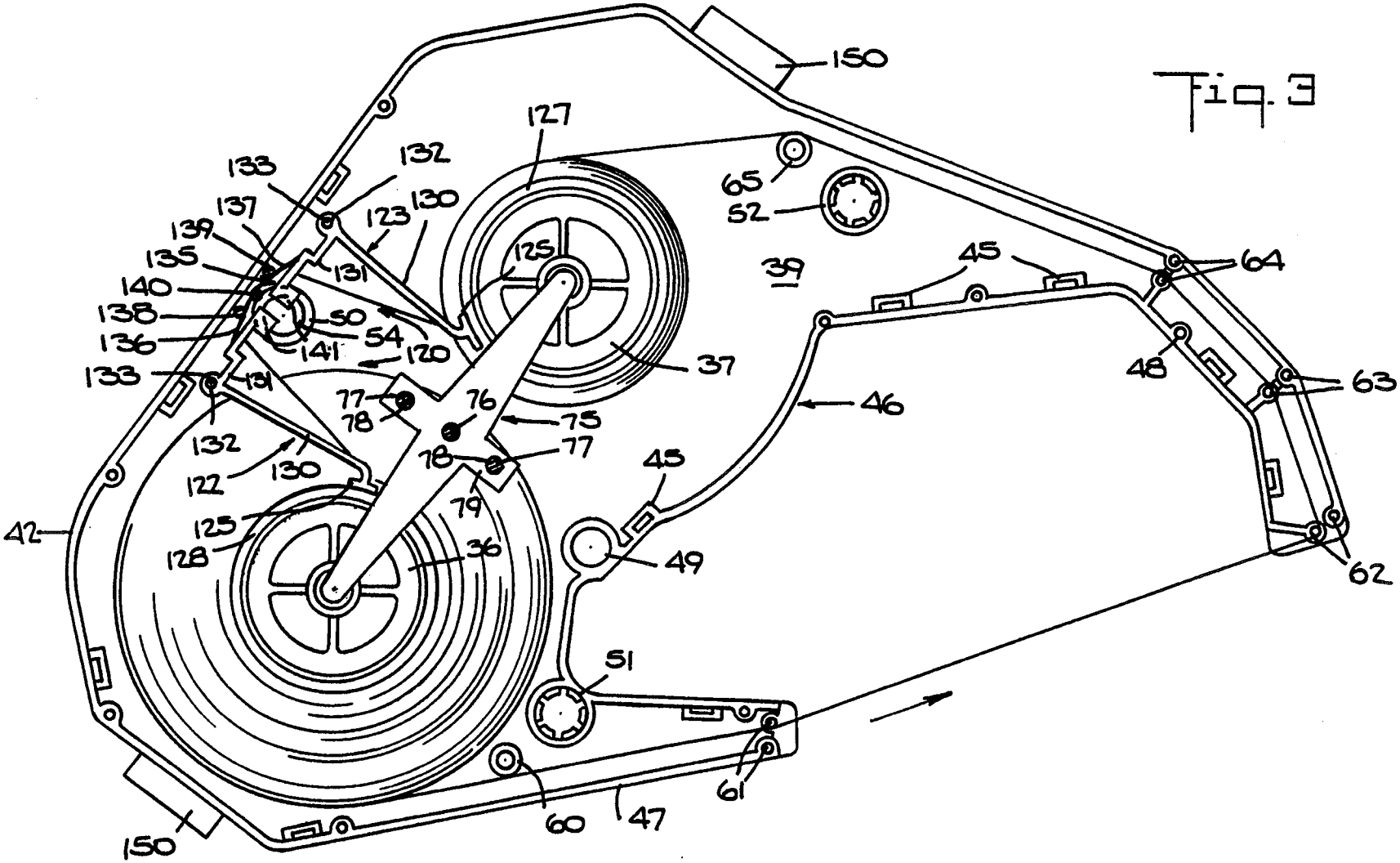
FIG. 3 is a turret side view of the cassette of FIG. 1 with the left end of the cassette housing removed, showing a leaf spring which in use is attached to the left side of the cassette, and with the cassette unmounted.
Figure 4:
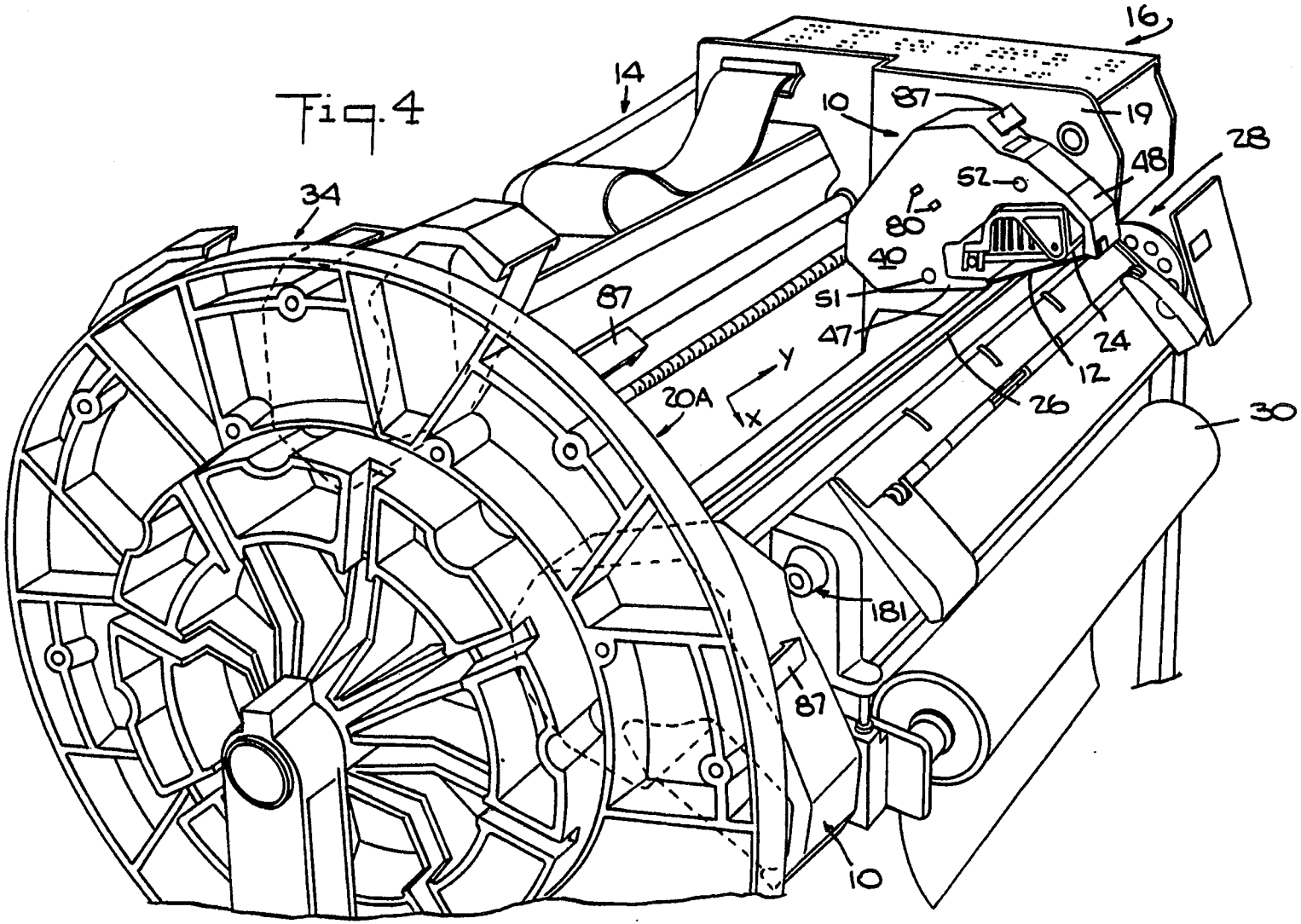
FIG. 4 is a front perspective view from the left side of a thermal printer including a print carriage, a ribbon cassette of FIG. 1 mounted to the print carriage with the print carriage in its extreme right end position, and a turret for storing a plurality of the cassettes shown in FIG. 1.
Figure 5:
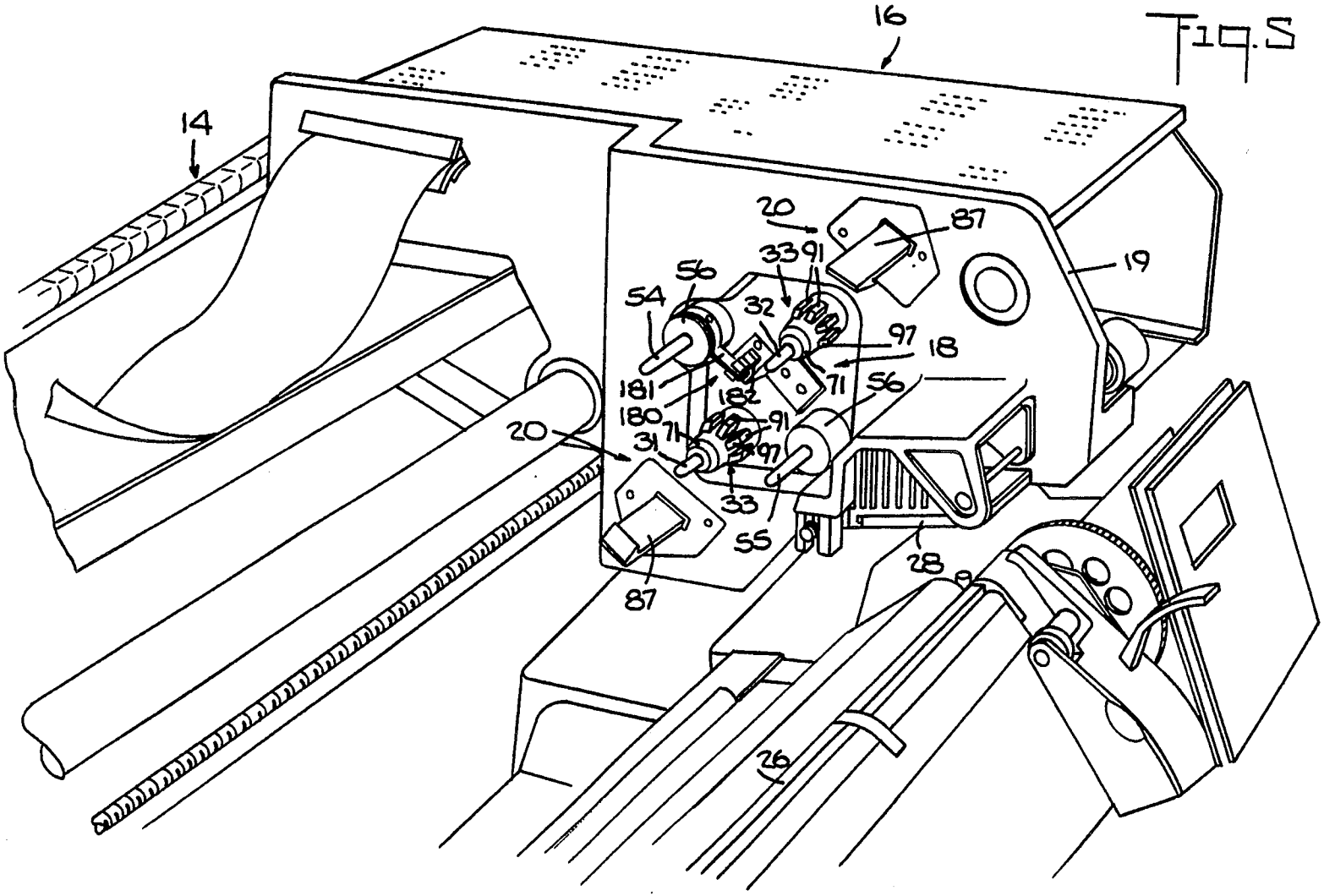
FIG. 5 is an enlarged perspective view similar to that of FIG. 4 of the right side of the thermal printer depicted in FIG. 4 with the ribbon cassette removed from the print carriage.
Figure 12:
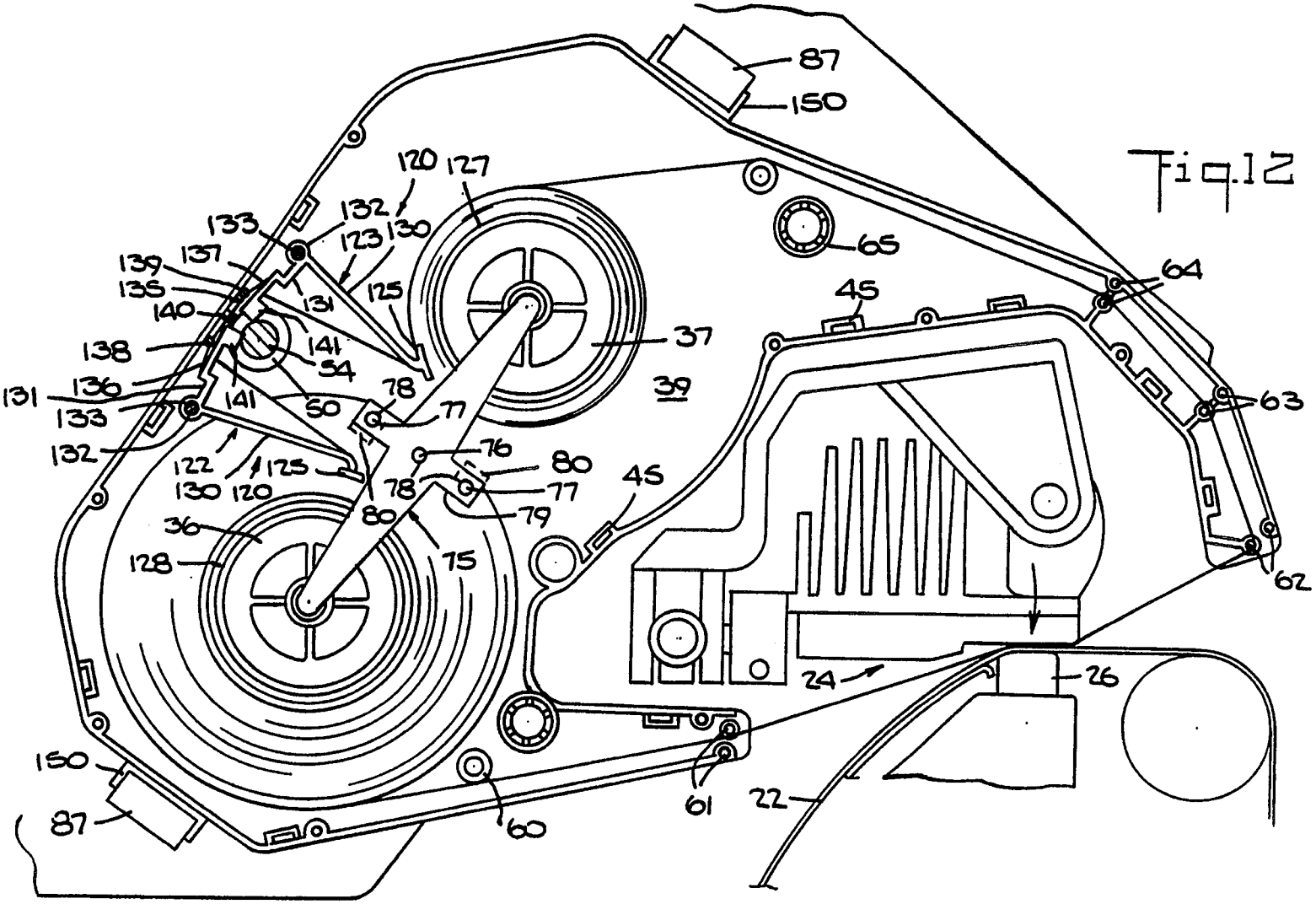
FIG. 12 is a side view of the cassette of FIG. 5 with the left side of the cassette removed and the cassette mounted to the print carriage.

Cassette 10 shown in FIGS. 1–3 carries a thermal donor material in the form of a ribbon 12 which is employed in the thermal printing process described in the cited applications and carried out by the thermal printer 14 shown in FIGS. 4 and 5 and also described in the cited applications. Referring to FIGS. 4, 5 and 12, thermal printer 14 includes a print carriage 16 on which is mounted a cassette drive 18 (FIG. 5) and a cassette holder 20. Thermal printer 14 prints an image on receptor sheet medium 22 (FIG. 12) in the strip printing mode described in detail in the cited applications employing a thermal print head 24 (FIGS. 4 and 12) and a thermal donor material or ribbon 12 carried in cassette 10. The receptor sheet medium 22 may be paper, plastic, mylar, etc.; the thermal transfer ribbon 12 may be a conventional film having a heat activated pigment, wax, resin, ink, etc. ("ink") layer thereon; and the thermal print head 28 may be conventional in so far as the construction and operation of the thermal elements are concerned. However, as mentioned above and explained in detail in the cited applications, the X-axis length of thermal print head 28 is approximately two inches, and thermal printer 14 prints in strips about two inches wide. The width of ribbon 12 must therefore be at least two inches wide, and in the preferred embodiment is about 2.25 inches wide. To accommodate such a wide ribbon, to mount the ribbon reels in the cassette, and to allow for other functions such as driving and braking of the ribbon reel, cassette 10 is about three inches wide.

As discussed herein and in the cited applications, mounting, guiding and printing in strip mode presents certain problems which the inventions disclosed herein and in the cited applications overcome.

Figure 11:
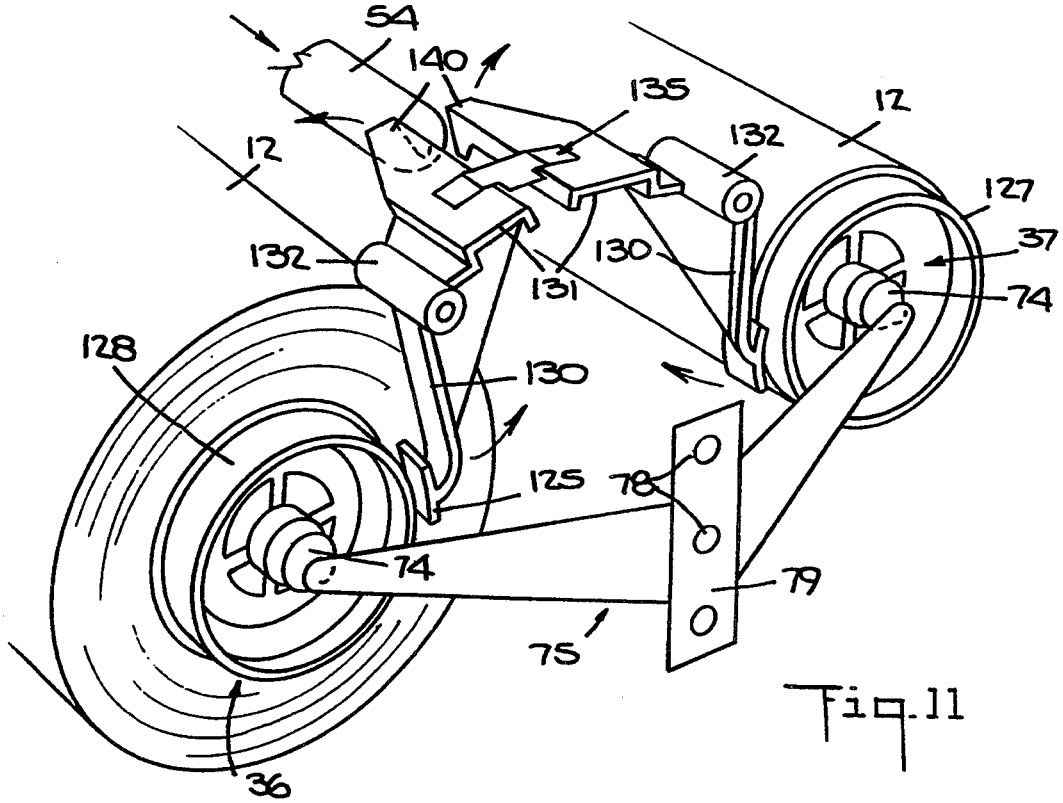

Referring to FIGS. 4, 5 and 12, print carriage 16 carries thermal print head 24 above a platen 26 which cooperates with thermal print head 24 and ribbon 12 to transfer ink from ribbon 12 to the sheet medium 22. The thermal printer 14 also includes a Y-axis drive system (not shown) for moving print carriage 16 back and forth over platen 26 parallel to the Y-axis (left-right in FIG. 4), and an X-axis drive system 28 for moving the sheet medium 22 back and forth over platen 26 parallel to the X-axis. The X- and Y- axes are referenced in FIG. 3 in accordance with convention, where the Y-axis is parallel to the line direction or scan direction of printers and plotters (parallel to platen 26), and the X-axis is parallel to the sheet medium feed direction which is perpendicular to the Y-axis. Sheet medium 22 (FIG. 12) is fed from a roll 30 mounted to the frame of printer 14, past print head 24 and platen 26, as shown in FIG. 11, and to X-axis drive system 28, which is not fully illustrated in the drawings.

Referring to FIG. 5, print carriage 16 supports cassette 10 for moving ribbon 12 from a supply reel 36 (FIGS. 1 and 12) in cassette 10 past print head 24 to a take-up reel 37 in cassette 10, and also supports the cassette holder 20 for retaining a cassette on carriage 16. Cassette drive system 18 is described in detail in the cited applications. Briefly, cassette drive system 18 includes a supply spindle 32 (FIG. 5) and a take-up spindle 31 which project from wall 19 on print carriage 16 behind which parts of cassette drive 18 are housed. Mounted to take-up spindle 31 and to supply spindle 32 are drive hubs 33. Movement of ribbon 12 from supply reel 36 to take-up reel 37 is described below. Guide pins 54 and 55 on print carriage 16 and guide pins 170 and 171 on turret 34 help support cassette 10 when it is mounted to the print carriage or turret, respectively, and assist during transfer of a cassette between print carriage 16 and turret 34. Cassette 10 is removably mounted to print carriage 16 as described below and in the cited applications.

Figure 6:
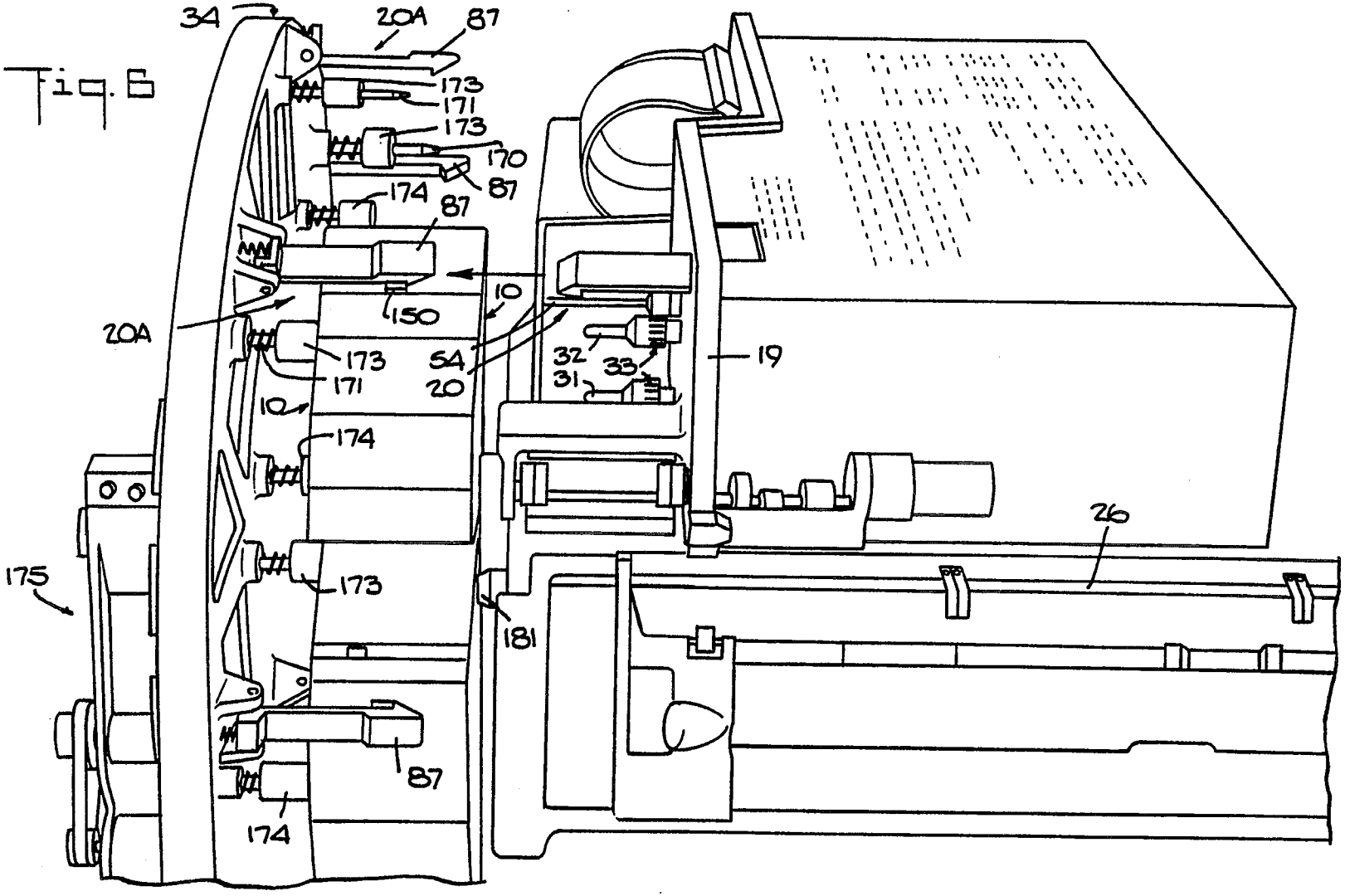
FIG. 6 is a front view of the left end of the thermal printer depicted in FIG. 4 showing the print carriage in its left end position about to remove a cassette from the storage turret.

Printer 14 may print in monochrome or color. For color printing, a number of ribbons of desired final colors are provided or an color system is provided, e.g., a four color system comprising yellow, magenta, cyan and black, or both. Loading and unloading of cassettes 10 to and from print carriage 16 for color printing, or simply for loading a fresh cassette on print carriage 16, is automated. Referring to FIGS. 4 and 6, a number of cassettes 10 may be stored on a turret 34 located in the Y-axis path of travel of print carriage 16 at the left end thereof (but may be located at either the right or the left end). As discussed above, in the presently preferred embodiment, the four color (yellow, magenta, cyan and black) system is used. Both a primary and a redundant four color system are provided, so that a total of eight cassettes are mounted to turret 34. As also discussed above, the number of cassettes to be mounted on turret 34 impacts on the size, configuration and mounting of the cassettes on turret 34 and the size of turret 34. Turret 34 is indexed by a controller in printer 14 to position a desired cassette (or unoccupied cassette holder) on turret 34 into a cassette transfer position aligned with the cassette holder 20 mounted on print carriage 16.

A passive cassette transfer system is used (e.g. retention arms 87 and lugs 150), i.e., the devices actively involved with a cassette transfer are not in a servo system and are not controlled by a controller. Rather, these devices simply passively react to movement of the print carriage 16 during a cassette transfer operation. Specifically, the cassette holders 20 and 20A on print carriage 16 and turret 34 are structured to permit automatic and passive transfer of a cassette from an occupied cassette holder on carriage 16 or turret 34 to an unoccupied cassette holder on turret 34 or carriage 16, respectively, simply by moving aligned cassette holders on the print carriage and turret into and out of engagement with each other. Sequences for transferring a cassette between turret 34 and print carriage 16 are described in the cited applications and below. Referring now to FIG. 1, ribbon cassette 10 comprises a cassette housing 35, the thermal donor ribbon 12, the ribbon supply reel 36 and the ribbon take-up reel 37. Cassette housing 35 comprises major side 39 (right or carriage side) and opposed major side 40 (left or turret side), and a peripheral side or edge 42. Since in cassette use side 39 faces carriage 16 and side 40 faces turret 34, side 39 is referred to as the carriage side (or right side with respect to the printer 14 shown in FIG. 4), and side 40 is referred to as the turret side (or left side of the cassette). Side 39 and side 42 are integrally joined and form a one piece receptacle or enclosure open at one major side. Cassette housing 12 is made of plastic, and sides 39 and 42 are integrally molded as one piece as presently preferred, or can be ultrasonically or heat welded together. Side 40 closes the receptacle or enclosure defined by sides 39 and 42, and may be removably attached to peripheral side 42 or non-removably attached to peripheral side 42 as by ultrasonic or heat welding.

In an embodiment of cassette 10 in which side 40 is removable, cassette 10 is provided with a snap arrangement for removably attaching side 40 to peripheral side 42, comprising flexible tabs 43 having a barbed or hooked end (not shown) projecting from side 40, and recesses 44 in peripheral side 42 terminating in an opening 45 (FIG. 3) in an edge of which the barb on tab 43 is engaged. Pressing a tab 43 inwardly disengages it from peripheral side 42 so that side 39 may be removed from the cassette. Sides 39, 40 and 42 are configured to define a cassette body 46 and arms 47 and 48 projecting from cassette body 46. Supply and take-up reels 36 and 37 are rotatably mounted within cassette body 46, and ribbon 12 is guided from supply reel 36 to take-up reel 37 by internal guides described below and arms 47 and 48.

In accordance with the invention, side 40 is made removable so that the used ribbon in cassette 10 may be removed, replaced with new ribbon and the cassette reused. In that embodiment, cassette 10 need not be disposable. If ribbon replacement is carried out at the factory, the used ribbon can be properly disposed of. Also, the cassette housings may be re-used, and therefore need not be disposed of. However, as indicated above, side 40 can be non-removably attached to cassette housing 35 if it is desired to make cassette 10 fully disposable. Cassette housing 35 may also be made so that sides 39 and 40 may be removed to remove the ribbon and reels in the cassette, but may not be easily reattached. In short, cassette housing 35 may be made so that the entire cassette is disposed of without any recycling, or so that a side may be removed but not replaced and the cassette housing and ribbon are separated for separate disposal or recycling, or without the cassette be used again, or so that a side may be removed and easily replaced so that the ribbon can be recycled or disposed of and replaced in cassette, and the cassette reused.

Referring to FIGS. 1 and 2, cassette body 46 has four holes 49–52 used in mounting cassette 10 to print carriage 16 or turret 34, and in transferring a cassette 10 between them. Holes 49 and 50 open on carriage side 39 and are guide holes used in mounting cassette 10 to print carriage 16. Holes 51 and 52 open on turret side 40 and are guide holes for mounting cassette 10 to cassette storage turret 34. Guide pins 54 and 55 on print carriage 16 (FIG. 5) enter holes 49 and 50 on carriage side 39, and guide pins 170 and 171 on turret 34 (FIG. 7) enter holes 51 and 52 on turret side 40. Guide pin 54 on print carriage 16 when fully received in guide hole 50 deactivates a brake mechanism 120 in cassette 10 which prevents reels 36 and 37 from rotating when cassette 10 is not mounted on print carriage 16, as discussed below. In the preferred embodiment, hole 50 is a blind hole because part of the brake mechanism 120 is mounted to the inside of side 40 in alignment with hole 50. Hole 49 is also a blind hole, but need not be. Holes 51 and 52 are through holes, but need only open on turret side 40 of the cassette. Other functions of guide holes 49–52 are discussed below.

An important consideration for proper strip mode thermal printing is the geometry of cassette 10 for the delivery and take-up of ribbon 12. Ribbon 12 must not be allowed to wrinkle prior to or during delivery to thermal print head 24. Additionally, the delivery path must prevent contact of unused ribbon by other parts of the thermal printer 14. Also, the departure angle of ribbon 12 from sheet medium 22 (FIG. 12) must be controlled and maintained not only because of geometric packaging considerations relating to the cassette and the thermal printer parts, but also because of peel angle and print head pressure considerations of the thermal printing process. The configuration and geometry of arms 58 and 59 and guides 60–65 is in response to those considerations.

Referring to FIG. 3 in which the turret side 40 of the cassette is not shown, ribbon 12 from supply reel 36 is guided to arm 47 by a single guide 60 and exits arm 47 passing a single guide 61. Ribbon 12 then extends outside of cassette 10 spaced from body 46, and re-enters cassette 10 through arm 48, in which three guides 62–64 guide ribbon 12 towards take-up reel 37. A single guide 65 guides ribbon 12 from arm 48 to take-up reel 37. In the thermal strip mode printer described in the cited applications, accurate tension control of the just printed ribbon is required for proper operation. Therefore, cassette 10 provides a low friction internal ribbon path in which there is minimal contact between the ribbon and the cassette, i.e., the number of ribbon guides are held to a minimum. Cassette 10 has only enough guide surfaces to ensure integrity of the ribbon path, and the guides are located so as to introduce gentle direction changes, which minimizes the frictional force as ribbon 12 passes over the guides. Referring to FIG. 12, in the preferred embodiment when cassette 10 is in use, each guide 60–65 introduces an oblique angle change in the path of ribbon movement, and there are no sharp (acute) angle changes in the path of ribbon movement. When cassette 10 is not in use (FIG. 2), there is only one sharp angle change introduced by guides 60–65, i.e., guide 62 introduces an angle change of approximately 90°.

Referring to FIGS. 1, 3, 7–9, the supply and take-up reels 36 and 37 are mounted in cassette 10 spring biased towards side 39 to ensure that stop surfaces 70 (FIGS. 7 and 8) on reels 36 and 37 are properly seated against stop surfaces 71 on the supply and take-up reel spindles 31, 32 of the cassette drive 18 when the cassette is mounted on the print carriage 16. To provide for spring-biasing while maintaining low frictional drag on reels 36, 37, each reel 36, 37 is provided with a pointed nipple 74 (FIGS. 7–12), which bears against a leaf spring 75 held in place adjacent cassette side 40 by dimples 76, 77 on side 40 snap-fitted into holes 78 in spring 75 (FIG. 10). The central part 79 of spring 75 is interleaved between dimple 76 on one side and dimples 77 on the other side. Center dimple 76 projects from cassette side 40 towards cassette side 39 and holds spring 75 off side 40, and the outer dimples 77 project from flanged portions 80 (FIGS. 2 and 12), which are attached to and spaced from side 40, towards side 40. Nipples 74 make essentially point contacts with leaf spring 75, which makes the resulting frictional drag imparted to the rotating reels 36, 37 from the stationary spring 75 very small. The ends 85 of reels 36, 37 (FIG. 1) opposite the pointed nipple ends are loosely fitted into holes 83 in the carriage side 39 of cassette 10 and are not rotatably connected to cassette housing 35. Holes 83 and respective generally semi-circular walls (not shown) coaxial with the axes of reels 36 and 37 on the inside of cassette side 39 loosely locate and guide reels 36 and 37. It is not necessary for cassette housing 35 to positively engage reel ends 85 since they are engaged by spindles 31 and 32 of the cassette drive 18 when cassette 10 is mounted to the print carriage 16.

This further reduces the frictional drag on reels 36, 37 imparted by cassette 10.

To further ensure smooth and low friction movement of ribbon 12, cassette 10 incorporates an anti-static feature. As ribbon 12 tracks through and out of cassette 10, through the printing process, then back into cassette 10, a static charge is built up on the surface of ribbon 12. If not contained and/or dissipated in a controlled fashion, this charge could build to a level substantial enough to adversely affect the printing process. For example, the charged ribbon 12 may tend to cling to the receptor sheet medium 22, the printhead 24, or its support mechanism, or other parts of the printer 14. To control such static build-up, the plastic cassette housing material is formulated with an anti-static agent, e.g., AKZO Armostat 555, or equivalent. Ribbon 12 is provided with a similar conductive agent in its backcoating, so that static charge on ribbon 12 tends to be conducted away from ribbon 12 onto the cassette housing 35 which is, in turn, firmly in contact with (grounded to) the printer 14. Ribbons with such conductive backcoatings are conventional and are commercially available.

As with any paper handling machine such as a printer, there is the potential for paper and office dust to be present within the confines of the machine. Should these contaminants be allowed to accumulate on the ribbon 12, it could affect print or plot quality by preventing complete transfer of the ink from ribbon 12 onto the receptor sheet medium 22 (paper) in localized areas. Hence, cassette housing 35 serves to shield the unused ribbon from potential contaminants until just prior to use in the printing process. The ribbon is exposed to potential contamination for only its last 2.5 inches of travel immediately prior to use in the printing process. At a slow print speed of 1 inch per second, that corresponds to only a 2.5 second exposure window.

Referring to FIGS. 4 and 5, a cassette 10 is mounted to the cassette drive 18 (part of which is shown in FIG. 5) on print carriage 16 with print head 24 positioned between cassette body 46 and ribbon 12. Cassette holder 20, which includes retention arms 87 and guide pins 54 and 55, holds a cassette 10 on print carriage 16 with the cassette drive 18 engaged with the cassette reels 36 and 37, as described below. Referring to FIG. 5, cassette drive 18 includes the supply reel spindle 31, the take-up reel spindle 32 and a drive motor (not shown) which rotates the take-up reel spindle 32. A brake (not shown) engages take-up reel spindle 32 to introduce drag on ribbon being unwound from supply reel 36 so that the ribbon may be tensioned. The supply reel spindle 31 and the take-up reel spindle 32 both include a drive hub 33 mounted to rotate with the respective spindle. Drive hub 33 has axially extending, radially projecting ribs or teeth 91 and the stop surface 70 discussed above. The supply reel 36 and the take-up reel 37 both include a drive sprocket 94 (FIG. 7) mounted to rotate with the respective reel. Drive sprockets 94 have axially extending, radially projecting ribs or teeth 95 and the stop surface 70.

Figure 8:
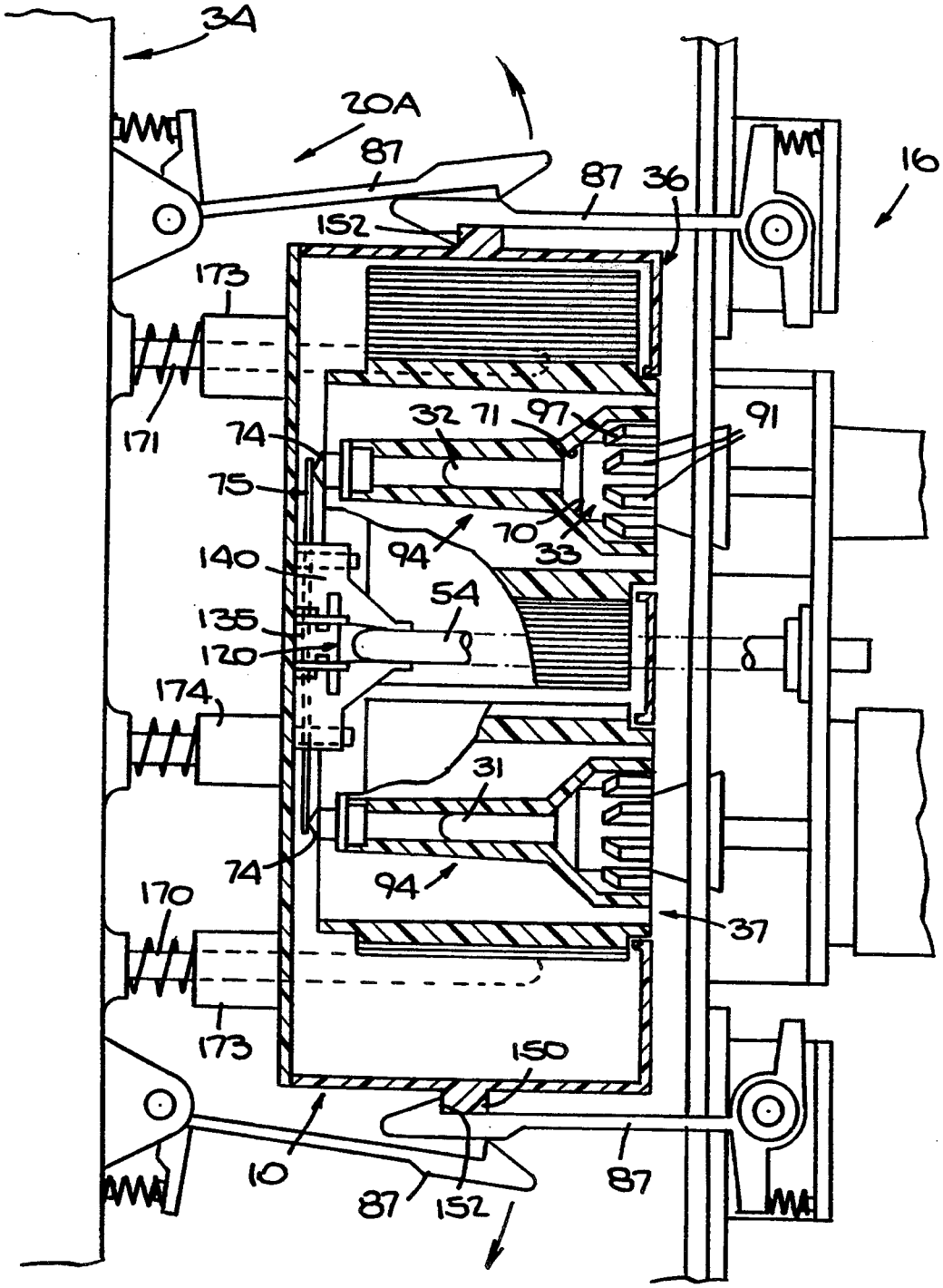
Figure 9:
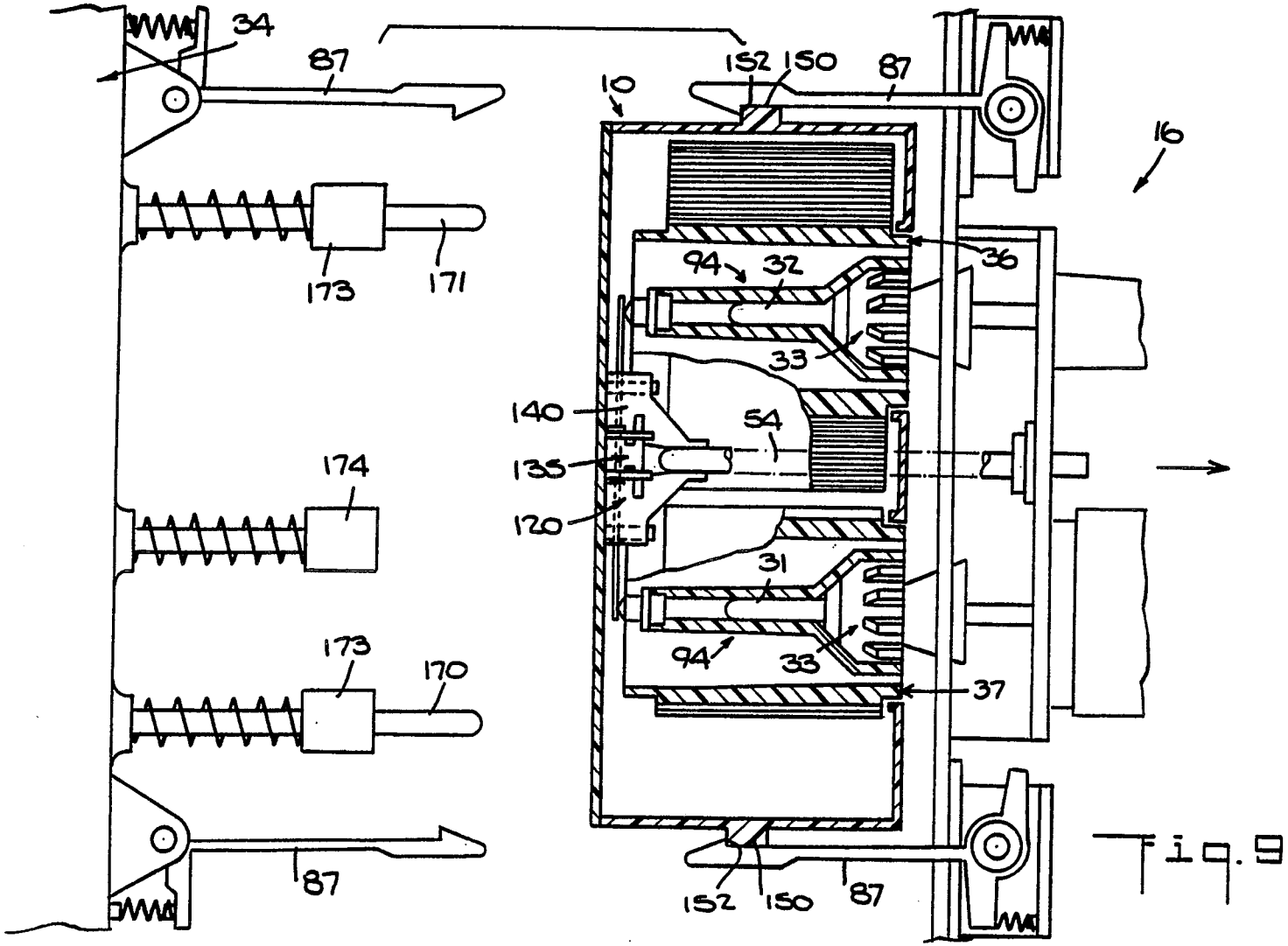
Figure 10:
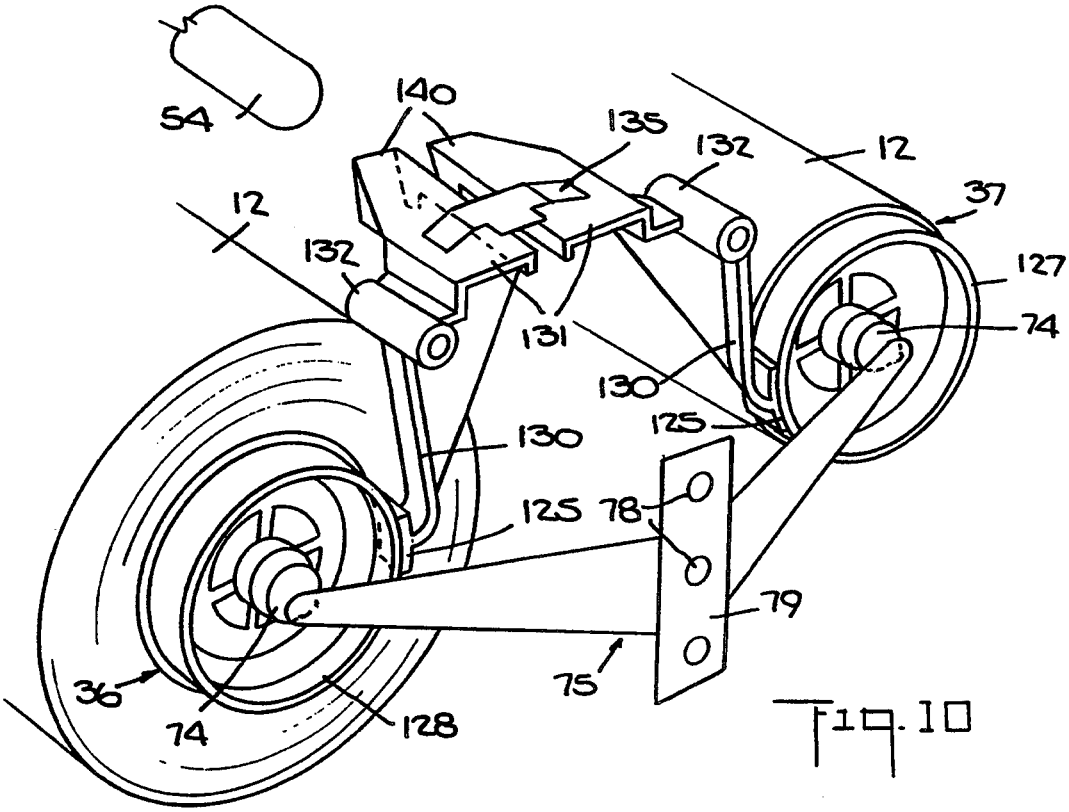
FIGS. 10 and 11 are perspective views of the turret side of the cassette of FIG. 1 with the left side of the cassette housing removed, showing in FIG. 10 the brake mechanism in engagement with the supply and take-up reels and in FIG. 11 the brake mechanism not in engagement with the supply and take-up reels.

As illustrated in FIGS. 8 and 9, when a respective spindle is seated in a respective reel with the stop surfaces 70 and 71 in contact, ribs 91 on the spindle drive hub 33 mesh with ribs 95 on the reel drive sprocket 94. When a cassette 10 is mounted to the cassette drive 18, it is possible that the ribs 91, 95 on a drive hub 33 and drive sprocket 94 are aligned and therefore interfere with meshing of the ribs. To permit meshing in such a case without rotating either the supply reel 36 or the take-up reel 37, the drive hubs 33 are mounted axially displaceable on respective spindles 31, 32, and the ribs 91, 95 have tapered portions 97, 98 facing each other. In an interference situation, a drive hub 33 is simply displaced axially (not shown), thereby allowing the cassette 10 to be mounted and engaged to the cassette drive 18. Then, when the take-up spindle 32 is rotated, the corresponding drive sprocket 94 on take-up reel 37 remains stationary while the tapered portions 97, 98 slide relative to each other a short distance until the respective ribs mesh. The take-up reel 37 is then rotated by the drive hub 33 of the take-up spindle 32, which rotates the supply reel 36, and causes the ribs 91, 95 on the drive hub 33 for the supply spindle 31 and the drive sprocket 94 for the supply reel 36 to also mesh if they have not already done so when the cassette 10 was mounted to the cassette drive 18.

The arrangement described above, and the brake mechanism 120 for supply reel 36 and take-up reel 37, described below, ensure that there is no movement of ribbon 12 between the time a cassette 10 is removed from cassette drive 18 on print carriage 16 and remounted at a later time. This prevents the exposed ribbon from developing a slack loop during storage and exchange. If the span of ribbon outside cassette 10 were allowed to go slack, the resulting form of the span would be unpredictable and could interfere and become entangled with nearby machine structure and mechanisms during the cassette exchange process or could twist or crinkle making that part of the ribbon unusable. Also, if ribbon 12 were allowed to move when a cassette 10 was removed from the cassette drive 18, then an unused part of the ribbon may have moved into position for the next printing operation. In other words, the ribbon could have moved so that a used part of the ribbon is in position to be used again, which could affect the quality of the print or produce a print with a skip in it. Also, if the ribbon moved in the opposite direction so that an unused part of the ribbon moved past the printing location, such ribbon part would not be used and would be wasted. Where a cassette is mounted and demounted a number of times, the risk of the problems described above occurring is considerable.

Referring to FIGS. 3 and 12, cassette 10 includes a brake mechanism 120 which frictionally engages supply reel 36 and take-up reel 37 when cassette 10 is not mounted to cassette drive 18 on print carriage 16. Brake mechanism 120 includes two brake pawls 122, 123 each carrying a brake pad 125, and drums 127, 128 respectively axially extending from the inner rims of the supply reel 36 and the take-up reel 37. Brake pads 125 are made of a relatively high friction material and when engaged with respective drums 127, 128, as shown in FIG. 3, hold the respective reels in place and prevent them from rotating when cassette 10 is not mounted to cassette drive 18.

Brake pawls 122, 123 (FIGS. 3 and 10–12) are L-shaped members having an arm 130, a leg 131 and a tubular hole 132 at the point where the arm 130 and leg 131 are connected. Respective brake pads 125 are connected to the free ends of respective brake pawl arms 130. Pins 133 project from the inner surface of cassette end 39 adjacent the peripheral side 42 of cassette 10, and a respective tubular hole 132 is placed on a respective pin 133 to pivotally mount each brake pawl 122, 123 to cassette side 40. A leaf spring 135 is mounted between legs 131 of brake pawls 122, 123 and the peripheral side 42 of cassette 10 with each free end 136, 137 of spring 135 bearing against a respective brake pawl leg 131. Pins 138, 139 and 140 projecting from cassette side 40 adjacent leaf spring 35 hold leaf spring 135 in place. Leaf spring 135 is positioned under stress between pins 138 and 139 on one side, and pin 140 on the other side.

Each leg 131 of a respective brake pawl 122,123 includes at the free end thereof a beveled projection (or cam) 141 (FIGS. 10–11) functioning as a cam extending perpendicular to the longitudinal extent of the leg, i.e., towards side 39 of cassette 10. The cams 141 taper in thickness, becoming thicker in the direction of cassette Side 40. Brake pawls 122 and 123 are positioned so that cams 141 are aligned with hole in cassette side 39 so that they are contacted by guide pin 54 of cassette holder 20 on print carriage 16 when cassette 10 is mounted to cassette drive 18 on the print carriage. When cassette 10 is mounted to print carriage 16 as shown in FIG. 12, guide pin 54 cams brake pawls 122,123 against leaf spring 135 causing respective brake pawls to pivot away from respective reels 36, 37 so that respective brake pads 125 do not frictionally engage respective drums 127, 128.

When cassette 10 is not mounted to cassette holder 20 on print carriage 16, as for example when it is mounted to turret 34 or is off printer 14 altogether, as shown in FIG. 3, leaf spring 135 urges respective arms 130 of brake pawls 122, 123 towards respective reels 36, 37 to frictionally engage respective brake pads 125 with respective drums 127,128. The sequence for pivoting brake pawls 122, 123 out of engagement with respective drums 127 is illustrated in FIGS. 7–11, which is described below in connection with the transfer of a cassette 10 from turret 34 to print carriage 16.

For the reasons discussed above, brake pads 125 engage the outer surface of drums 127, 128 in a continuous manner, i.e., the contact surfaces of brake pads 125 and drums 127, 128 are continuous, as opposed to toothed in a pawl and ratchet arrangement. This allows brake pawl arms 130 to engage respective drums 127, 128 in any angular position thereof, i.e., in an infinite number of angular positions as opposed to a discrete number of angular positions in a pawl and ratchet arrangement. As mentioned above, brake pads 125 directly engage drums 127, 128 attached to the respective reels 36, 37, as opposed to contacting ribbon 12 so as not to stress ribbon 12 or damage the ink on ribbon 12 or to otherwise damage ribbon 12. Also, brake pawls 122,123, brake pawl arms 130 and brake pads 125 are configured and/or arranged to apply a greater breaking force to the respective drum 127, 128 when torque is applied to the respective reel 36, 37 to unwind ribbon from the respective reel. This feature minimizes the force which spring 135 must supply to pivot the respective brake pawl arms towards the respective drums 127, 128.

Cassette holders 20 and 20A on print carriage 16 and turret 34, respectively, each include two retention arms 87 (see FIGS. 4–6) which engage respective lugs 150 on the peripheral side 42 of cassette 10 as described in detail in the '116 Application. Briefly, the end of each retention arm 87 is structured so as to engage a lug 150 on the peripheral side 42 of cassette 10 and thereby retain a cassette. Also the end of each retention arm 87 is structured to permit a retention arm of an unoccupied cassette holder to cam a retention arm of an occupied holder out of engagement with the lug on the retained cassette that the later holds, and into engagement with the retention arm of the unoccupied holder, thereby effecting a passive, automatic and direct transfer of a cassette from one holder to the other simply by moving aligned cassette holders into and out of engagement with each other.

Figure 7:
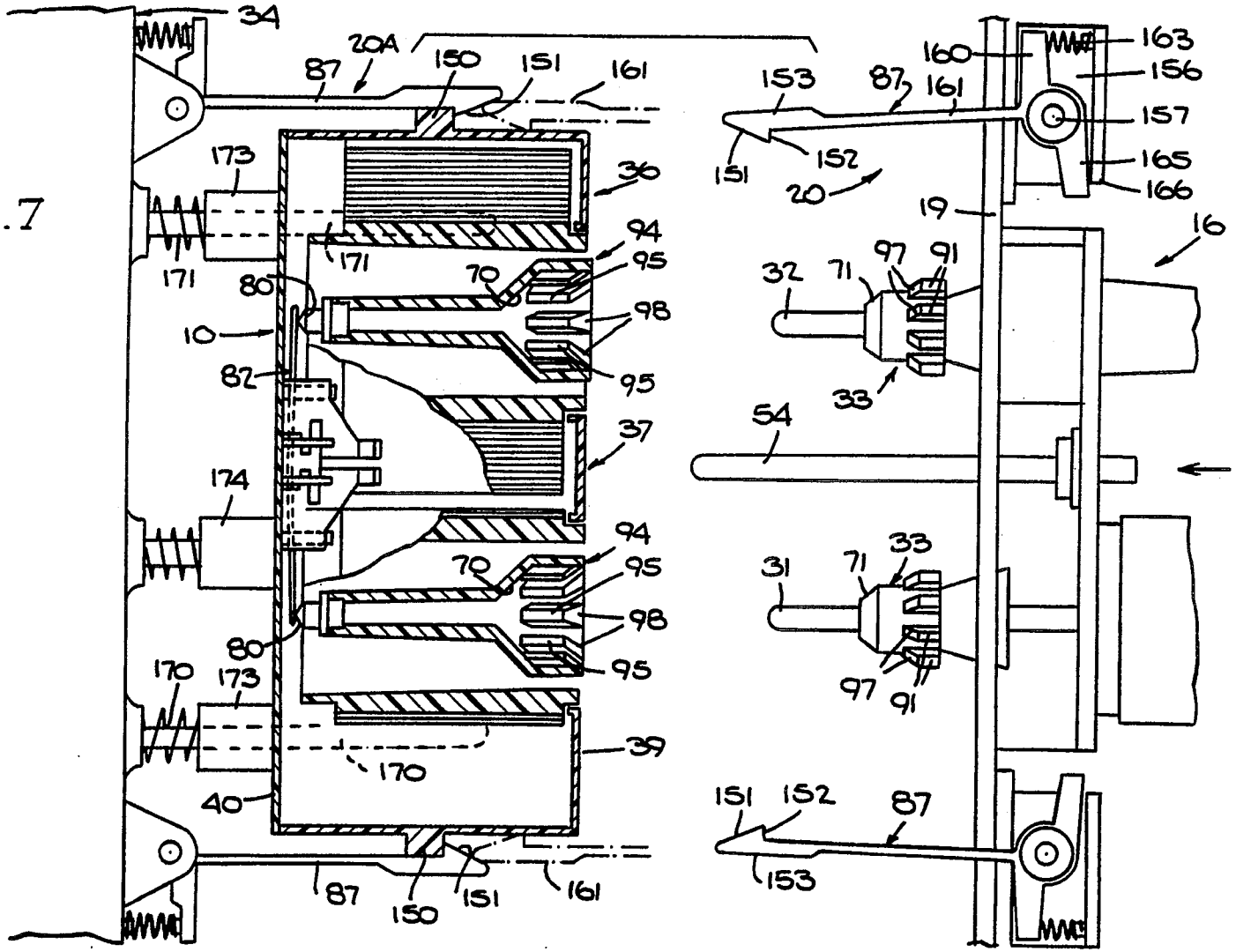
FIGS. 7, 8 and 9 are enlarged section views of a portion of the storage turret and print carriage, showing cassette mounting structure on the turret, and cassette mounting and reel driving structure on the print carriage, and illustrating transfer of a cassette from the turret to the print carriage and engagement of brakes in the cassette with the ribbon supply and take-up reels.

With reference to FIG. 7, the end of each retention arm 87 resembles in cross section the tip of a fish hook, and is structured as follows. On one side of the end of each retention 87 extends a sloping camming surface 151 which begins with a right angle detent surface 152. The other side 153 of the end of retention arm 87 opposite camming surface 157 is straight. Lugs 150 are positioned on the peripheral side 42 of cassette 10 to contact and engage respective right angle detent surfaces 152 of respective retention arms 87 to thereby mount cassette 10 to print carriage 16 or turret 34. Two locating guide pins 54 and 55 which are pre-loaded with spring-loaded plungers 56 on print carriage 16, and two locating guide pins 170, 171 which are preloaded with spring-loaded plungers 173 on turret 34 properly locate cassette relative to print carriage 16 and turret 34, respectively, during a transfer between turret 34 and carriage 16. However, to properly seat and load cassette 10 on turret 34 an additional spring-loaded offset plunger 174 (without a guide pin) is provided to prevent a cassette being transferred to turret 34 from pivoting or cocking under the action of retention arms 87 engaging lugs 150. Guide holes 51 and 52 on turret side 40 of cassette 10 (FIG. 1) are not symmetrically located relative to the supply and take-up reels 36 and which account for most of the weight of cassette 10, and are not symmetrically located relative to the center of gravity of cassette 10 the center of the lug/retention arm forces. Offset plunger 174 on turret 34 frictionally engages side 40 of cassette 10 and effectively prevents the cassette from rotating when it is being transferred to turret 34. Holes 49 and 50, which are used to mount cassette 10 to carriage 16, are generally centrally located in cassette 10, and a line joining the centers of holes 49 and 50 passes through the central region of cassette 10. Holes 49 and 50 on carriage side 39 of cassette 10, are symmetrically located relative to the supply and take-up reels 36 and 37 and straddle the center of gravity of cassette 10 and the center of the lug/retention arm forces. Therefore, there is less tendency for the cassette to cock when it is being transferred to carriage 16 as retention arms 87 on print carriage 16 engage lugs 150 on cassette 10. Therefore, an off-set plunger is not needed on carriage 16.

Referring to FIG. 7, each retention arm 87 is pivotally mounted at one end thereof to an ear 156 by a pivot joint 157. Retention arm 87 at the end thereof pivoted to ear 156 has an extension 160 extending therefrom at a right angle to the main part 161. A compression spring 163 is mounted in engagement with the end of arm extension 160 and wall 19 to urge main part 161 of retention arm 87 to pivot towards cassette 10 to cause the right angle detent surface 152 of a respective arm 87 to engage a respective lug 150 on cassette 10. A stop to limit pivoting of retention arm 87 toward cassette 10 comprises another extension 165 extending from retention arm 87 in the opposite direction to extension 160, and a projection 166 on wall 19 extending up to extension 165. With no cassette held between retention arms 87, pivoting of retention arm 87 is stopped by engagement of extension 165 with projection 166. Cassette holders 20, 20A function to retain a cassette between retention arms 87 as also described in the '116 Application.

Referring to FIGS. 5–7, the automatic exchange system for transferring cassettes 10 between turret 34 and print carriage 16 depends on the set of two guide pins 170 and 171 and offset plunger 174 located on turret 34 and the set of two guide pins 54 and 55 located on print carriage 16. During the exchange the process, the guide pins serve to maintain cassette location and orientation ensuring that the retention arms 87 engage the lugs 150 properly. The size of the holes 49–52 in cassette 10 is determined by the maximum expected tolerance stackup between the cassette/turret and cassette/carriage interfaces. In short, the guide pin holes 49–52 in the cassette 10 must be large enough to accept the most misaligned guide pin. The cassette's guide pin holes 49–52 are located according to several criteria. The carriage-side holes 49 and 50 are the most favorably located because they are responsible for locating and maintaining the cassette position during the actual printing operation. As discussed above, holes 49 and 50 are symmetrically located relative to the supply and take-up reels 36 and 37 and straddle the center of gravity of cassette 10 and the center of the lug/retention arm forces. The turret-side holes 51 and 52 are less favorably located since they only serve to locate and maintain the cassette during storage on turret 34. Also, all of the guide pin holes are located such that they do not interfere with the internal ribbon path. Finally, the guide pin holes are located in such a way as to provide the maximum stance in holding the cassette both on turret 34 and on print carriage 16.

Referring to FIGS. 7–9, like the guide pin holes 49–52, the lugs 150 on cassette 10 are configured and located in such a way as to provide the most reliable passive exchange system possible. The width of lug 150 is largely arbitrary and the depth of lug 150 is set to provide adequate structural integrity of the lug. However, the height of lug 150 is closely tied to the kinematics of the passive retention arms 87. Specifically, the height of lug 150 is set such that, during exchange, the approaching retention arm 87 will always be able to "get under" the engaged retention arm 87. The interaction between the cassette lugs 150 and the passive retention arms 87 is fundamental to the operation of the exchange system.

Four guide holes are provided in cassette 10 and two guide pins on both turret 34 and print carriage 16 to ensure that a cassette is always adequately supported during a transfer operation. With four guide holes, two on each major side 39, 40 of cassette 10, four pins will support cassette 10 as the cassette is transferred from one set of retention arms 87 on the print carriage or turret to the other set on the turret or print carriage, respectively. If only one set of two holes opening in both sides 39 and 40 of cassette 10 were used, then guide pins on turret 34 and print carriage 16 would have to share the same guide holes during a transfer operation, so that the respective guide pins would have to be only half the thickness of cassette 10 and the cassette would not be supported as stably during a transfer and when mounted.

Referring to FIGS. 7–9, the spring loaded plungers 173 on guide pins 170, 171 on turret 34, and the spring-loaded plungers 56 on guide pins 54 and 55 on carriage 16 assist in seating a cassette 10 and in transferring a cassette 10 during a cassette transfer as follows. While at rest, the respective set of spring-loaded plungers acts to force the cassette lugs 150 against the right angle detent surfaces 157 of the ends of the respective retention arms 87. This ensures accurate, repeatable axial location of the cassette. During a cassette transfer, the set of the spring-loaded plungers 173 or 56 on guide pins 170, 171 and 54, 55, respectively, act to counter the force imparted by the retention arms 87 of the approaching cassette holder 20 or 20A mounted to print carriage 16 or turret 34. By providing a force for the unoccupied retention arms 87 of the print carriage or turret to act against, the unoccupied retention arms 87 can perform their camming motions against the occupied retention arms 87 and on the cassette lugs 150 on the cassette to be transferred. The resilient mounting of cassette 10 also guards against jamming, bending, and breakage while always ensuring that the cassette is returned to a known position, i.e., engagement of the lugs 150 on the cassette against the right angle detent surface 152 of the retention arms 87.

FIGS. 7–9 show the sequence for mounting a cassette 10 to cassette drive 18 on print carriage 16. First, turret 34 is rotated by turret drive 175 (FIG. 6) to position the desired cassette holder 20A in a cassette exchange position under control of the printer controller. The turret drive 195 and indexing of turret 34 are described in the '116 Application. Referring to FIG. 7, cassette 10 is shown mounted to turret 34. Retention arms 87 engage lugs 150, and guide pins 170, 171 on turret 34 (FIG. 6) are received in holes 51 and 52 (FIG. 1) in side 40 of cassette 10. As indicated above, each guide pin 170, 171 (FIG. 6) has mounted thereto a spring loaded, axially movable plunger 173. When cassette 10 is mounted to turret 34, spring loaded plungers 173 urge the cassette lugs 150 into engagement with the retaining surface 152 of retention arms 87, as shown in FIG. 7. In FIG. 7, print carriage 16 and the cassette drive 18 are moving towards but are still spaced from cassette 10 on turret 34. As movement of print carriage 16 towards turret 34 continues, the ends of retention arms 87 of cassette holder 20 mounted to print carriage 16 contact the ends of retention arms 87 of cassette holder 20A on turret 34, as shown in broken lines in FIG. 7. The unoccupied set of retention arms 87 are pivoted inwardly towards each other, is shown in FIG. 7, which causes the outer surface 153 of the ends of the unoccupied retention arms 87 on the carriage cassette holder 20 to contact the inner camming surfaces 151 of the occupied retention arms 87 of the turret cassette holder 20A.

Referring to FIG. 8, as movement of print carriage 16 towards turret 34 continues, the unoccupied retention arms 87 of carriage cassette holder 20 disengage the occupied retention arms 87 of turret cassette holder 20A from lugs 150, and the formerly occupied retention arms 87 on turret 34 pivot outwardly. Movement of print carriage 16 towards turret 34 continues until stopped by the printer controller in response to an encoder (not shown) which tracks movement of the print carriage. At that point in the sequence, which is shown in FIG. 8, retention arms 87 of carriage cassette holder 20 engage lugs 150 on cassette 10, plungers 56 of guide pins 54 and 55 engage cassette 10, drive hubs 33 of supply spindle 31 and take-up spindle 32 are fully or partially seated in drive sprockets 94 of supply and take-up reels 36 and 37, and guide pin 54 is contacting camming surfaces 140 of brake pawls 122, 123 to pivot brake pawl arms 130 away from reel drums 127, 128. Drive hubs 33 may be partially or fully seated, depending upon whether respective ribs 97, 98 mesh or not, as described above. To complete the sequence, print carriage 16 is moved in the opposite direction, as shown in FIG. 9, taking with it cassette 10. During a transfer operation, cassette 10 is supported by all four guide pins 54, 55 and 170, 171. Transfer of a cassette 10 on carriage 16 to turret 34 proceeds in essentially the same way, but with the unoccupied and unengaged retention arms 87 of holder 20A on turret 34 and the occupied and engaged retention arms 87 of holder 20 on print carriage 16 being reversed from the positions shown in FIGS. 6–9.

A sensor 180 mounted to wall 39 on print carriage 16 senses the presence of a fully seated cassette 10 on print carriage 16. Sensor 180 comprises a blade member 181 fixed to plunger 56 on spindle 54 which enters and trips an optical switch 182 when cassette 10 is fully seated. (When cassette 10 is fully seated, it drives plunger 56 back far enough to cause blade member 181 to interrupt a beam of infrared light in optical switch 182 to trip the switch.) The optical switch 182 is coupled to the printer controller.

FIGS. 10 and 11 depict the sequence for pivoting brake pawls 122, 123 to move pawl arms 130 away from and out of engagement with reel brake drums 127,128. FIG. 9 shows guide pin 38 approaching the camming surfaces 141 of brake pawls 122, 123. At this point, brake pawl arms 130 are urged into engagement with reel drums 127, 128 by leaf spring 135. Referring to FIG. 10, when the end of guide pin 38 contacts camming surfaces 141, it causes brake pawl 122 to pivot counterclockwise and brake pawl 133 to pivot clockwise against the action of leaf spring 135, which moves brake pawl 130 arms away from the respective drums. When cassette 10 is removed from print carriage 16, guide pin 54 is withdrawn, which allows leaf spring 135 to pivot brake pawl 122 clockwise (FIG. 10) and brake pawl 123 counterclockwise, which causes the brake pads 125 on brake pawl arms 130 to engage respective drums.

Referring to FIG. 1, a machine readable bar code 180 is affixed to (or imprinted on) side 39 of cassette 10. Bar code 180 identifies the ribbon type, color, supplier, etc. Cassettes 10 are mounted to turret 34 with major sides 40 parallel to a plane in which the active side of turret 34 lies (see FIG. 6), and with major side 40 facing turret 34 and major side 39 facing away from turret 34 with the bar code 180 exposed. Referring to FIG. 4, a bar code reader 181 is mounted to the frame of thermal printer 14 adjacent turret 34, spaced therefrom by slightly more than the thickness of a cassette 10. The bar code 180 on each cassette 10 which is mounted to turret 34 is read by bar code reader 181 whenever a cassette is loaded onto turret 34. The printer controller thereby "knows" the identity of each cassette 10 on turret 34 so a cassette 10 designated by the print data of the print being executed by printer 14 may be located and moved into the cassette exchange position for transfer from turret 34 to print carriage 16.

The bar codes 180 on cassettes 10 are read "on the fly", i.e., as turret 34 is rotated. Because a linear bar code is employed and because each bar code moves in a circular path, care must be taken to ensure that the entire linear bar code is read as it moves in a curved path past the stationary bar code reader 181.

Bar code 180 (FIGS. 1 and 4) is located on cassette 10 so that it will be at the greatest possible radius from the center axis of turret 34 when cassette 10 is mounted thereto. Bar code 180 is a linear bar code, and its location at the greatest possible radius from the center of turret 34 minimizes temporal distortion when it is rotated past the stationary bar code reader 181. Using a linear bar code rather than one in which the bar code elements extend about the arc of a circle simplifies design of the bar code.

The bar code elements (FIG. 1) have equal heights and are aligned (linearly) along a longitudinal axis which extends approximately perpendicular (89°) to a line intersecting the axes of supply reel 36 and take-up reel 37. Since the bar code elements are aligned in a straight line, and each cassette 10 on turret 34 is rotated along a curved path past bar code reader 181 (FIG. 4), each point on the straight line does not pass the same point on bar code reader 181. Therefore, there is a relationship between the position, height and length of the linear bar code 180 and its elements, and the position and field of view of the bar code reader 181 such that a substantial portion of each bar code element passes the bar code reader 181.

In order to permit visual determination of the amount of unused ribbon in each cassette 10, as shown in FIG. 1, a window 185 is provided in cassette side 39 near supply reel. Window 185 may simply be an opening in cassette end 39, or may be a transparent insert seated in the opening, or a transparent part of cassette 10, etc.

While the invention has been described and illustrated in connection with preferred embodiments, many variations and modifications as will be evident to those skilled in this art may be made without departing from the spirit and scope of the invention. The invention as set forth in the appended claims is thus not to be limited to the precise details of construction set forth above as such variations and modifications are intended to be included within the spirit and scope of the invention as defined in the appended claims.

What is claimed is:

1. A ribbon cassette comprising:

a housing having opposed first and second major sides parallel to each other, a peripheral edge, and an outlet for a ribbon and an inlet for the ribbon;

there being first and second spaced holes in said first major side for receiving respective pins projecting from a mounting structure for mounting said cassette to the mounting structure with said first major side facing the mounting structure, and third and fourth spaced holes in said second major side for receiving respective pins projecting from a mounting structure for mounting said cassette to that mounting structure with said second major side facing that mounting structure.

2. A ribbon cassette comprising:

a housing having opposed first and second major sides parallel to each other, a peripheral edge, and an outlet for a ribbon and an inlet for the ribbon;

there being first and second spaced holes in said first major side for receiving pins projecting from a mounting surface;

a pair of spaced projections on said peripheral edge of said housing for engaging arms on a mounting structure;

engagement of the arms on a mounting structure with said lugs and entry of the pins projecting from the same mounting structure in said first and second holes cooperating to mount said cassette to that mounting structure with said first major side facing that mounting structure.

3. The cassette of claim 2 wherein there are third and fourth spaced holes in said second major side for receiving respective pins projecting from a mounting structure, engagement of arms on that same mounting structure with said lugs and entry of the pins projecting from that same mounting structure into said third and fourth holes cooperating to mount said cassette to that mounting structure with said second major side facing that same mounting structure.

4. The ribbon cassette of claim 1 or 3 wherein said cassette has a center of gravity, and wherein said first and second holes are positioned as follows: said first hole is positioned on one side of the center of gravity adjacent said peripheral edge of said cassette; said second hole is positioned on an opposite side of the center of gravity adjacent said peripheral edge; and said first and second holes are positioned such that a first line connecting the center of said first and second holes passes through a central part of said cassette.

5. The ribbon cassette of claim 4 wherein said third and fourth holes are substantially spaced apart with each positioned adjacent said peripheral edge of said cassette and such that a second line connecting the center of said third and fourth holes intersects said first line at an angle of from about 60° to about 120°.

6. The ribbon cassette of claim 4 wherein said second line intersects said first line at an angle of about 90°.

7. The ribbon cassette of claim 1 or 3 wherein said first and second holes and said third and fourth holes are positioned and configured to accept pins simultaneously through said first and second major sides.

8. The cassette of claim 1 or 3 wherein said housing comprises a body and includes spaced arms projecting from said body which terminate in said inlet and outlet, said first and second holes being positioned in said body spaced from said arms, and said third and fourth holes being positioned in or near said arms.

9. The cassette of claim 1 or 3 comprising a first reel rotatably mounted in said housing having an axis perpendicular to said major sides and a second reel rotatably mounted in said housing having an axis perpendicular to said major sides, said first and second reels being laterally spaced in said housing, wherein said first and second holes are positioned such that a first line connecting the center of said first and second holes passes between respective axes of said reels and a second line connecting the center of said third and fourth holes does not.

10. A ribbon cassette comprising:

a housing having opposed first and second major sides parallel to each other, a peripheral edge, and an outlet for a ribbon and an inlet for the ribbon;

there being first and second spaced holes in said first major side for receiving respective pins projecting from a first mounting structure for mounting said cassette to the first mounting structure with said first major side facing the first mounting structure, and third and fourth spaced holes in said second major side for receiving respective pins projecting from a second mounting structure for mounting said cassette to the second mounting structure with said second major side facing the second mounting structure;

said cassette being structured such that there is space within said cassette for all of the pins of the first and second mounting structures to simultaneously project a substantial distance within said cassette, whereby all of said pins at least guide said cassette during an operation in which said cassette is being transferred between the first and second mounting structures.

11. The ribbon cassette of claim 1 or 2 wherein said cassette is structured such that there is space within said cassette for the pins to project within the cassette a distance sufficient to guide said cassette as it is being mounted to the mounting structure.

12. The ribbon cassette of claim 1 or 2 wherein said cassette is structured such that there is space within said cassette for the pins to project within the cassette a distance sufficient to support said cassette on the mounting structure.

13. The ribbon cassette of claim 1 or 2 wherein said cassette is structured such that there is space within said cassette for the pins to project within said cassette substantially from major side to major side.

14. The combination of a plurality of ribbon cassettes each having a linear bar code thereon, mounting apparatus for mounting a plurality of said ribbon cassettes thereto, and apparatus for machine reading the bar codes on said cassettes while said cassettes are mounted to said mounting apparatus, comprising:

each of said cassettes comprising a housing having opposed major sides parallel to each other, a peripheral edge, an outlet for a ribbon and an inlet for the ribbon, means associated with said cassette for mounting it to said mounting apparatus with one of said major surfaces facing said mounting apparatus, and a bar code positioned on the major side opposed to said one major side;

said mounting means comprising a mounting element for mounting a plurality of said cassettes to said mounting element in an adjacent relationship extending about a circle with said one major side of each of said cassettes facing said mounting element and said opposing major side of each of said cassettes having a bar code thereon facing away from said mounting element;

said means for machine reading the bars codes comprising means for rotating said mounting element, and a bar code reader positioned adjacent said mounting element spaced therefrom sufficiently to permit said cassettes to pass by said bar code reader;

the linear bar code being positioned on each of said cassettes and said cassettes being positioned on said mounting element such that the linear bar code on each cassette passes said bar code reader when said mounting element is rotated.

15. The combination of claim 14 wherein said linear bar code is mounted on said opposing major side adjacent said peripheral side of said cassette at substantially the greatest radius from the axis of rotation of said mounting element.

16. A ribbon cassette comprising:

a ribbon having a conductive coating thereon for conducting static charge;

a housing having opposed first and second major sides parallel to each other, a peripheral edge, and an outlet for said ribbon and an inlet for said ribbon;

means for mounting said ribbon in said cassette such that said ribbon may be moved from within said cassette to said outlet and from said inlet to within said cassette;

said cassette housing being made of plastic which includes a conductive additive, and said housing being in contact with said conductive coating of said ribbon as said ribbon is moved for conducting static charge on said ribbon from said ribbon to said housing.

17. A ribbon cassette comprising:

a housing having opposed major sides parallel to each other, a peripheral edge, and an outlet for a ribbon and an inlet for the ribbon;

a first reel having an axle fixed to said supply reel to rotate therewith, said axle having an end facing away from one side of said supply reel which is rounded to provide an area of contact thereon which is substantially less than the cross-sectional area of said axle;

a second reel having an axle fixed thereto to rotate therewith, said axle having an end facing away from one side of said second reel which is rounded to provide an area of contact thereon which is substantially less than the cross-sectional area of said axle;

means for rotatably mounting in said housing said first reel and said second reel, said mounting means including a planar surface having relatively low friction held from rotating in said housing and positioned in said housing adjacent each said ends of said axles on which said ends of said axles bear and rotate;

said first reel and said second reel each including structure engageable through respective holes in a first of said major sides of said cassette by apparatus for rotating or braking a respective reel from a side of said reel opposite said one side; and guiding means for loosely guiding said reels at said ends opposite said one end while permitting said reels to rotate, said guiding means comprising respective holes in said first major side of said cassette which have a larger diameter than the diameter of said reels such that said holes loosely guide the outer periphery of said opposite sides of said reels, and means acting on said planar surfaces for resiliently urging said axles towards said first major side, whereby said reels are loosely captivated in said cassette when not engaged by the apparatus for rotating or braking.

18. A ribbon cassette comprising:

a housing having opposed major sides parallel to each other, a peripheral edge, and an outlet for a ribbon and an inlet for the ribbon;

a first reel rotatably mounted in said housing having an axis perpendicular to said major sides;

a second reel rotatably mounted in said housing having an axis perpendicular to said major sides;

means associated at least with said second reel for permitting said second reel to be driven;

mounting means associated with said housing which cooperates with mounting means associated with a mounting structure for mounting said cassette to the mounting structure;

a brake mounted in said housing for frictionally engaging at least one of said reels in any angular position thereof in response to said cassette not being mounted to said mounting structure and for not frictionally engaging said at least one reel in response to said cassette being mounted to the mounting structure.

19. The cassette of claim 18 wherein said housing has at least one hole therein for receiving a pin from the mounting structure, and wherein said brake does not frictionally engage said at least one reel when said pin is within said cassette through said hole, and wherein said brake frictionally engages said at least one reel when the pin is not in said hole.

20. The cassette of claim 18 wherein said brake comprises an arm pivotably mounted in said housing having a free end which frictionally engages said at least one reel in a first position of said arm and does not engage said at least one reel in a second position of said arm, means urging said arm into its first position, and means for pivoting said arm towards said second position in response to the mounting means of the mounting structure.

21. The cassette of claim 20 wherein said housing has at least one hole therein for receiving a pin from the mounting structure, and wherein said arm is pivoted to the second position in response to the presence of the pin is in the hole.

22. The cassette of claim 20 wherein said cassette mounting means includes at least one hole in said housing for receiving a pin associated with the mounting structure when said cassette is mounted to the mounting structure, said brake comprising means associated with said arm positioned in alignment with said hole so as to be contacted by the pin of the mounting means when the cassette is mounted to the mounting means to hold said arm in its second position, and wherein removal of the pin from said hole allows said arm to pivot to its first position with said free end of said arm in frictional engagement with said at least one reel.

23. The ribbon cassette according to claim 20 wherein said arm is configured and positioned so that when said arm is in frictional engagement with said reel, said arm applies a harder braking force to said at least one reel when said at least one reel is urged to rotate or does rotate in a direction to unwind ribbon therefrom.

24. A ribbon cassette comprising:

a housing having opposed major sides parallel to each other, a peripheral edge, and an outlet for a ribbon and an inlet for the ribbon;

a first reel rotatably mounted in said housing having an axis perpendicular to said major sides;

a second reel rotatably mounted in said housing having an axis perpendicular to said major sides;

at least one hole in said housing for receiving a pin associated with a mounting structure when said cassette is mounted to the mounting structure;

a brake mounted in said housing for frictionally engaging at least one of said reels in any angular position thereof when said cassette is not mounted to said mounting structure, and for not frictionally engaging said reel when the pin of the mounting structure is in said hole.

25. The cassette of claim 24 wherein said brake comprises an arm pivotably mounted in said housing having a free end which frictionally engages said at least one reel in a first position of said arm and does not engage said at least one reel in a second position of said arm, means urging said arm into its first position, and means associated with said arm aligned with said hole for pivoting said arm towards said second position in response to the pin entering a predetermined distance into said hole.

26. The cassette of claim 24 comprising a said brake for each of said reels.

* * * * *